US010286422B2

(12) United States Patent
Takahama et al.

(10) Patent No.: US 10,286,422 B2
(45) Date of Patent: May 14, 2019

(54) PAPER SHEET PROCESSING DEVICE, PAPER SHEET PROCESSING SYSTEM, AND PAPER SHEET PROCESSING METHOD

(71) Applicant: GLORY LTD., Hyogo (JP)

(72) Inventors: Tomohisa Takahama, Hyogo (JP); Hideki Yamamoto, Hyogo (JP); Shusuke Hashimoto, Hyogo (JP)

(73) Assignee: GLORY LTD., Hyogo (JP)

( * ) Notice: Subject to any disclaimer, the term of this patent is extended or adjusted under 35 U.S.C. 154(b) by 7 days.

(21) Appl. No.: 15/520,590

(22) PCT Filed: Sep. 15, 2015

(86) PCT No.: PCT/JP2015/076107

§ 371 (c)(1),
(2) Date: Apr. 20, 2017

(87) PCT Pub. No.: WO2016/063658

PCT Pub. Date: Apr. 28, 2016

(65) Prior Publication Data

US 2017/0304870 A1 Oct. 26, 2017

(30) Foreign Application Priority Data

Oct. 24, 2014 (JP) ..... 2014-217742
Nov. 6, 2014 (JP) ..... 2014-226442

(51) Int. Cl.
*B07C 5/34* (2006.01)
*B65B 13/20* (2006.01)
(Continued)

(52) U.S. Cl.
CPC ..... *B07C 5/34* (2013.01); *B65B 13/20* (2013.01); *B65B 13/24* (2013.01); *B65B 27/08* (2013.01);
(Continued)

(58) Field of Classification Search
CPC ..... B07C 5/34; B65B 13/20; B65B 13/24; B65B 27/08
USPC ..... 209/509, 534
See application file for complete search history.

(56) References Cited

U.S. PATENT DOCUMENTS 6,782,987 B1 * 8/2004 Abe ..... G07D 11/0084 194/207
7,780,159 B2 * 8/2010 Nishimura ..... G03G 15/6538 270/58.01
(Continued)

FOREIGN PATENT DOCUMENTS

JP 2009-104678 A 5/2009
JP 5091359 B2 12/2012
(Continued)

OTHER PUBLICATIONS

Extended European Search Report for 15853401.6 dated May 4, 2018.
(Continued)

*Primary Examiner* — Terrell H Matthews
(74) *Attorney, Agent, or Firm* — Brundidge & Stanger, P.C.

(57) ABSTRACT

This paper sheet processing device (100) for processing paper sheets is provided with: an identification unit (55) for identifying paper sheets; stacking units (60, 210) for stacking paper sheets on the basis of the content of classification types identified by the identification unit (55); and a control unit (50, 135, 550) that reads, from a memory unit (56, 136, 560) in which an upper limit of paper sheets to be stacked by the stacking units (60, 210) are stored in association with the content of classification types, the upper limit for paper sheets that correspond to the content of the classification types of the paper sheets stacked by the stacking units (60, 210), and sets the upper limit for paper sheets to be stacked by the stacking units (60, 210).

2 Claims, 18 Drawing Sheets

(51) Int. Cl.

| | |
|---|---|
| ***B65B 13/24*** | (2006.01) |
| ***B65B 27/08*** | (2006.01) |
| ***B65H 31/24*** | (2006.01) |
| ***G07D 9/00*** | (2006.01) |
| ***B65H 43/00*** | (2006.01) |
| ***B65H 43/04*** | (2006.01) |
| ***G07D 11/00*** | (2019.01) |
| *B65B 57/00* | (2006.01) |

(52) U.S. Cl.

CPC ..... *B65H 31/24* (2013.01); *B65H 43/00* (2013.01); *B65H 43/04* (2013.01); *G07D 9/00* (2013.01); *G07D 11/0051* (2013.01); *G07D 11/0084* (2013.01); *B65B 57/00* (2013.01); *B65H 2301/133* (2013.01); *B65H 2301/141* (2013.01); *B65H 2408/111* (2013.01); *B65H 2511/10* (2013.01); *B65H 2511/20* (2013.01); *B65H 2511/30* (2013.01); *B65H 2511/413* (2013.01); *B65H 2515/60* (2013.01); *B65H 2515/842* (2013.01); *B65H 2701/00* (2013.01); *B65H 2701/1912* (2013.01)

(56) References Cited

U.S. PATENT DOCUMENTS

2004/0007509 A1* 1/2004 Gubbey ..... G07D 11/0084 209/534
2007/0278064 A1 12/2007 Hallowell et al.
2008/0154426 A1* 6/2008 Kikuchi ..... B65H 31/24 700/219
2011/0229237 A1* 9/2011 Hayashi ..... B65H 3/44 400/76
2011/0285071 A1* 11/2011 Miyake ..... G03G 15/6541 270/58.07
2013/0328263 A1 12/2013 Asada
2015/0151945 A1* 6/2015 Kuroda ..... B65H 43/06 414/788.1
2015/0314978 A1* 11/2015 Miyajima ..... B41J 29/38 271/298
2016/0225215 A1* 8/2016 Yamaguchi ..... G07D 7/121
2017/0073100 A1* 3/2017 Nagase ..... B65H 5/002

FOREIGN PATENT DOCUMENTS

| | | | |
|---|---|---|---|
| JP | 2013-254392 | A | 12/2013 |
| WO | 2011/114516 | A1 | 9/2011 |
| WO | 2014/171040 | A1 | 10/2014 |

OTHER PUBLICATIONS

International Search Report from International Application No. PCT/JP2015/076107 dated Dec. 22, 2015.

* cited by examiner

PAPER SHEET PROCESSING DEVICE, PAPER SHEET PROCESSING SYSTEM, AND PAPER SHEET PROCESSING METHOD

TECHNICAL FIELD

The present invention relates to a paper sheet processing machine, a paper sheet processing system and a paper sheet processing method for processing a paper sheet.

Further, the present invention relates to a valuable medium handling machine, a valuable medium processing system and a valuable medium processing method for processing a valuable medium such as a banknote, a coin, a check, a gift certificate, a bar code ticket, and a chip.

BACKGROUND ART

Conventionally, a paper sheet processing machine which includes a reception unit for receiving a paper sheet, a transport unit for transporting a paper sheet received by the reception unit, an identification unit configured to identify a paper sheet transported by the transport unit, and a stacking unit configured to stack a paper sheet identified by identification unit is known (see, for example, Japanese Patent Application Laid-Open No. 2013-254392 and Japanese Patent Publication No. 5091359). In the disclosure of Japanese Patent Publication No. 5091359, the upper limit number of sheets to be stacked in the stacking unit is appropriately set.

In addition, conventionally, various settings for valuable medium handling machines such as a coin processing machine, and a banknote processing machine (a type of valuable medium handling machine) are known. For example, in the disclosure of WO No. 2011/114516, a threshold for determining the fitness of the banknote is set and stored in a storage unit. It is to be noted that the setting information also includes information relating to all settings in a valuable medium handling machine such as information relating to the type of a valuable medium to be housed in a housing unit, information relating to a display style in the display unit, and network setting information for connection to a network as well as the above-mentioned information relating to the threshold.

SUMMARY OF INVENTION

Technical Problem

However, Japanese Patent Publication No. 5091359 discloses only the upper limit number of the paper sheets to be stacked in the stacking unit, and does not disclose a configuration for setting the upper limit number of the paper sheets to be stacked in the stacking unit in accordance with the detail of the sort type of the paper sheets (such as the currency type, denomination of a banknote, printing type of a banknote, fitness of a paper sheet, face/back of a paper sheet and orientation of a paper sheet).

In view of this, an object of the present invention is to provide a paper sheet processing machine, a paper sheet processing system and a paper sheet processing method which can set the upper limit number of paper sheets to be stacked in a stacking unit in accordance with the detail of the sort type of the paper sheets.

Solution to Problem

A paper sheet processing machine of the embodiment of the present invention is configured to process a paper sheet, and includes: an identification unit configured to identify a paper sheet; a stacking unit configured to stack paper sheets based on a detail of a sort type identified by the identification unit; and a control unit configured to read an upper limit number of paper sheets corresponding to a detail of the sort type of paper sheets to be stacked in the stacking unit from a storage unit storing the upper limit number of the paper sheets to be stacked in the stacking unit linked with the detail of the sort type, and set the upper limit number of the paper sheets to be stacked in the stacking unit.

Preferably, in the paper sheet processing machine of the embodiment of the present invention, the sort type of the paper sheets includes a currency type, a denomination of a banknote, a printing type of a banknote or fitness of a paper sheet.

Preferably, in the paper sheet processing machine of the embodiment of the present invention, a plurality of the stacking units are provided, a plurality of the sort types are provided, the plurality of the sort types include a first sort type, the storage unit stores the upper limit number of the paper sheets to be stacked in the stacking unit linked with each of a plurality of details of the first sort type, and when paper sheets are stacked in two or more of the stacking units based on different details of the first sort type, the upper limit number of the paper sheets to be stacked in each of the two or more of the stacking units is set based on the details of the first sort type.

Preferably, in the paper sheet processing machine of the embodiment of the present invention, the plurality of the sort types include the first sort type and a second sort type, and paper sheets which are different from each other in detail of the first sort type, and are identical to each other in detail of the second sort type are stacked in the two or more of the stacking units.

Preferably, in the paper sheet processing machine of the embodiment of the present invention, the first sort type is fitness of a banknote, and the second sort type is a denomination of a banknote.

Preferably, in the paper sheet processing machine of the embodiment of the present invention, when the detail of the sort type of the paper sheets to be stacked in the stacking unit is changed, the upper limit number of the paper sheets to be stacked in the stacking unit is changed based on the changed detail of the sort type.

Preferably, in the paper sheet processing machine of the embodiment of the present invention, a detail of the fitness of the paper sheets includes a first type suitable for use in an external apparatus, a second type suitable for a use other than the external apparatus, and a third type which is unusable.

Preferably, in the paper sheet processing machine of the embodiment of the present invention, an upper limit number of sheets set for the first type is greater than an upper limit number of sheets set for the second type or an upper limit number of sheets set for the third type.

Preferably, in the paper sheet processing machine of the embodiment of the present invention, the upper limit number of sheets set for the second type is identical or substantially identical to the upper limit number of sheets set for the third type.

Preferably, in the paper sheet processing machine of the embodiment of the present invention, the sort type of the paper sheets includes a face or a back of a paper sheet or an orientation of a paper sheet.

Preferably, in the paper sheet processing machine of the embodiment of the present invention, on a basis of the detail of the sort type of the paper sheets identified by the identification unit, the control unit reads from the storage unit an upper limit number of paper sheets corresponding to the detail of the sort type of the paper sheets, and sets the upper limit number of the paper sheets to be stacked in the stacking unit to which the paper sheets are to be transported.

Preferably, in the paper sheet processing machine of the embodiment of the present invention, the detail of the sort type of the paper sheets to be stacked in the stacking unit is set in advance, and the control unit reads from the storage unit an upper limit number of paper sheets corresponding to the detail of the sort type of the paper sheets based on the detail of the sort type set in advance, and sets the upper limit number of the paper sheets to be stacked in the stacking unit.

Preferably, in the paper sheet processing machine of the embodiment of the present invention, the paper sheet processing machine is switchable to a changing mode for changing the upper limit number of paper sheets to be stacked in the stacking unit, the upper limit number being stored in the storage unit and linked with the detail of the sort type of the paper sheet.

A paper sheet processing system of the embodiment of the present invention includes a paper sheet processing machine configured to process a paper sheet, the paper sheet processing system including: an identification unit configured to identify a paper sheet; a stacking unit configured to stack paper sheets based on a detail of a sort type identified by the identification unit; a storage unit storing the detail of the sort type linked with an upper limit number of paper sheets to be stacked in the stacking unit; and a control unit configured to read from the storage unit an upper limit number of paper sheets corresponding to a detail of the sort type of the paper sheets to be stacked in the stacking unit, and set the upper limit number of the paper sheets to be stacked in the stacking unit.

A paper sheet processing method of the embodiment of the present invention uses a paper sheet processing machine configured to process a paper sheet, the paper sheet processing method including: identifying a paper sheet by an identification unit; and stacking paper sheets based on a detail of a sort type identified by the identification unit, in which an upper limit number of paper sheets corresponding to a detail of the sort type of paper sheets to be stacked in the stacking unit is read from a storage unit storing the upper limit number of the paper sheets to be stacked in the stacking unit linked with the detail of the sort type, and the upper limit number of the paper sheets to be stacked in the stacking unit is set.

Advantageous Effects of Invention

According to the embodiments of the present invention, the upper limit number of the paper sheets to be stacked in the stacking unit corresponding to the detail of the sort type is read from the storage unit, and the upper limit number of the paper sheets to be stacked in the stacking unit is set. Accordingly, the upper limit number of the paper sheets to be stacked in the stacking unit in accordance with the detail of the sort type of the paper sheets can be set.

Next, the operator and the like can appropriately change the above-described detail of setting information. However, when resetting the detail of the setting information to the original detail of the setting information after the detail of the setting information is changed, the setting information cannot be reset to the original detail of the setting information in some situation since the setting of the setting information is complicated. In addition, there is a possibility that the valuable medium handling machine does not normally operate after the detail of the setting information is changed, and in that case, if the detail of the setting information cannot be reset to the original detail of the setting information, the processing of a valuable medium in the valuable medium handling machine is stopped.

In view of the foregoing, an object of the present invention is to provide a valuable medium handling machine, a valuable medium processing system and a valuable medium processing method in which the detail of the setting information can be easily reset to the original detail of the setting information even in the case where the detail of the setting information is changed.

A valuable medium handling machine of the embodiment of the present invention includes a control unit configured to control the valuable medium handling machine with history information of the setting information for operating a valuable medium handling machine read from a storage unit storing the history information.

Preferably, in the valuable medium handling machine of the embodiment of the present invention, the storage unit stores the history information such that the operator and the setting information are associated with each other.

Preferably, in the valuable medium handling machine of the embodiment of the present invention, the storage unit stores the history information such that date or time and the setting information are associated with each other.

Preferably, in the valuable medium handling machine of the embodiment of the present invention, the setting information acquired at a given interval is stored in the storage unit as the history information.

Preferably, in the valuable medium handling machine of the embodiment of the present invention, setting information of a time when the valuable medium handling machine is used is stored in the storage unit as history information.

Preferably, in the valuable medium handling machine of the embodiment of the present invention, when setting information is changed, new setting information after the change or setting information prior to the change is stored in the storage unit as history information.

Preferably, the valuable medium handling machine of the embodiment of the present invention further includes an output unit configured to output a list of the history information.

Preferably, the valuable medium handling machine of the embodiment of the present invention further includes an identification unit configured to identify the valuable medium, in which history information of the setting information includes a threshold used for identifying the valuable medium in the identification unit.

Preferably, the valuable medium handling machine of the embodiment of the present invention further includes a transport unit configured to transport the valuable medium, an identification unit configured to identify the valuable medium transported by the transport unit, a housing unit configured to house the valuable medium transported by the transport unit, and a display unit configured to display predetermined information, in which the history information includes at least one of history information of setting information relating to identification of a valuable medium in the identification unit, history information of setting information relating to a type of a valuable medium to be housed in the housing unit, history information of setting information relating to a display style in the display unit, and history information of setting information relating to network connection.

Preferably, the valuable medium handling machine of the embodiment of the present invention further includes an output unit configured to output one or more pieces of the history information associated with acquired operator information.

Preferably, in the valuable medium handling machine of the embodiment of the present invention, the output unit outputs latest history information of the history information associated with acquired operator information.

Preferably, in the valuable medium handling machine of the embodiment of the present invention, the history information includes setting information for at least one item, and the storage unit stores setting information for each item.

Preferably, in the valuable medium handling machine of the embodiment of the present invention, the output unit outputs history information of setting information for each item.

Preferably, in the valuable medium handling machine of the embodiment of the present invention, the output unit outputs history information of setting information for a plurality of the item at once.

A valuable medium process system of the embodiment of the present invention includes a storage unit storing history information of setting information for operating a valuable medium handling machine, an output unit configured to output the history information from the storage unit, and an operation unit for selecting at least one piece of setting information from among the history information output from the output unit.

A valuable medium processing method of the embodiment of the present invention includes outputting history information of setting information for operating a valuable medium handling machine which is read from a storage unit storing the history information, and selecting at least one piece of setting information from among the output history information.

According to the embodiment of the present invention, it is possible to read history information of setting information for operating a valuable medium handling machine. Accordingly, even in the case where the detail of the setting information is changed, it is possible to easily reset detail of the setting information to the original detail of the setting information by reading history information.

DESCRIPTION OF EMBODIMENTS

Embodiments of the present invention are described below with reference to the accompanying drawings.

First Embodiment (Configuration)

A paper sheet processing machine, a paper sheet processing system and a paper sheet processing method according to an embodiment of the present invention are described below with reference to the accompanying drawings. Here, FIG. 1 to FIG. 9 are drawings for describing the embodiment of the present invention.

It is to be noted that the term "paper sheet processing system" herein includes "paper sheet processing machine 100." That is, the "paper sheet processing system" herein can be paper sheet processing machine 100, or a configuration including paper sheet processing machine 100 and other components. It is to be noted that the "paper sheet" herein is a banknote, a check, a gift certificate, a continuous-form sheet or and the like, and typically, the "paper sheet" is a banknote.

Figure 1:
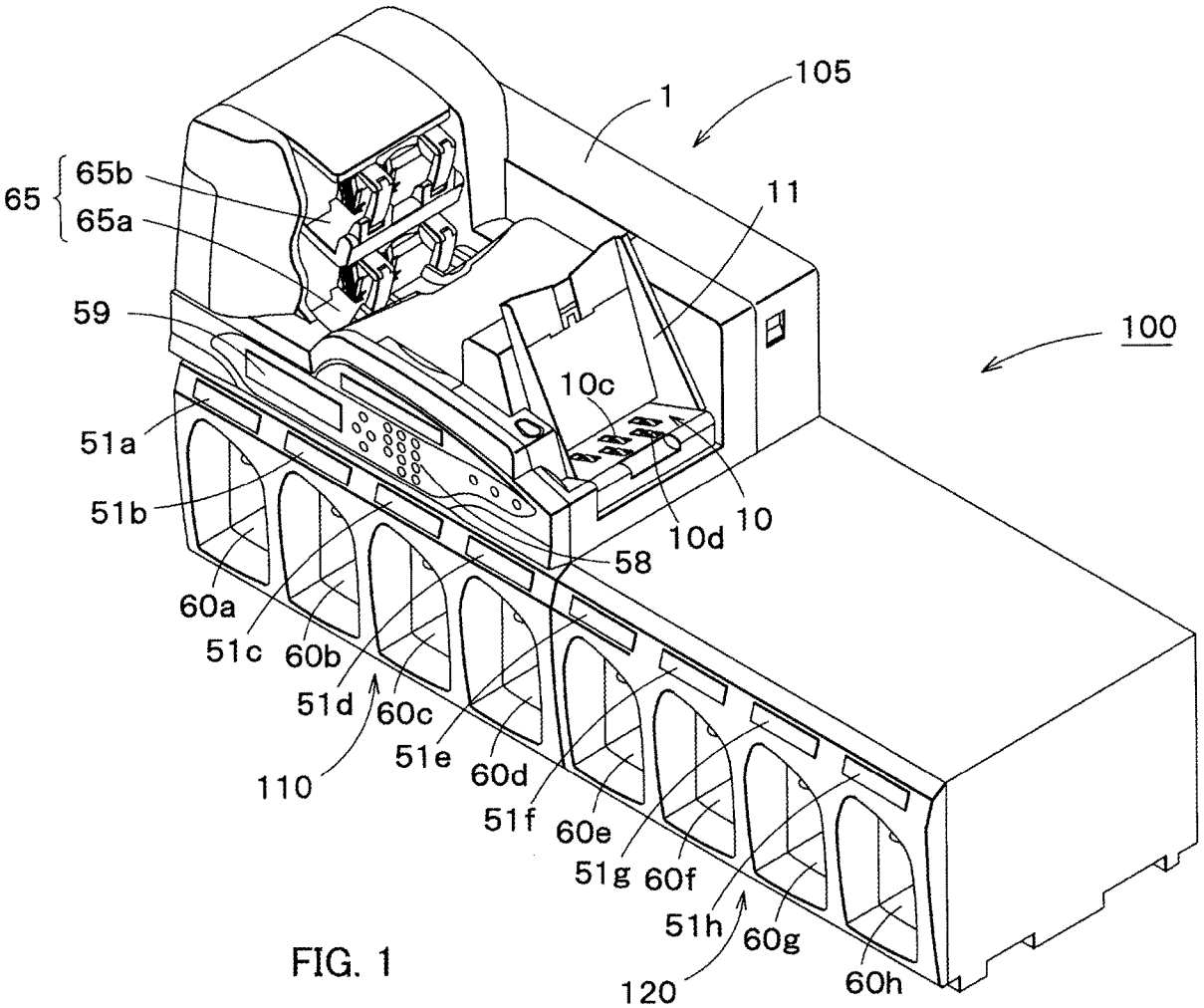
FIG. 1 is a perspective view illustrating an external appearance of a paper sheet processing machine of a first embodiment of the present invention.
Figure 2:
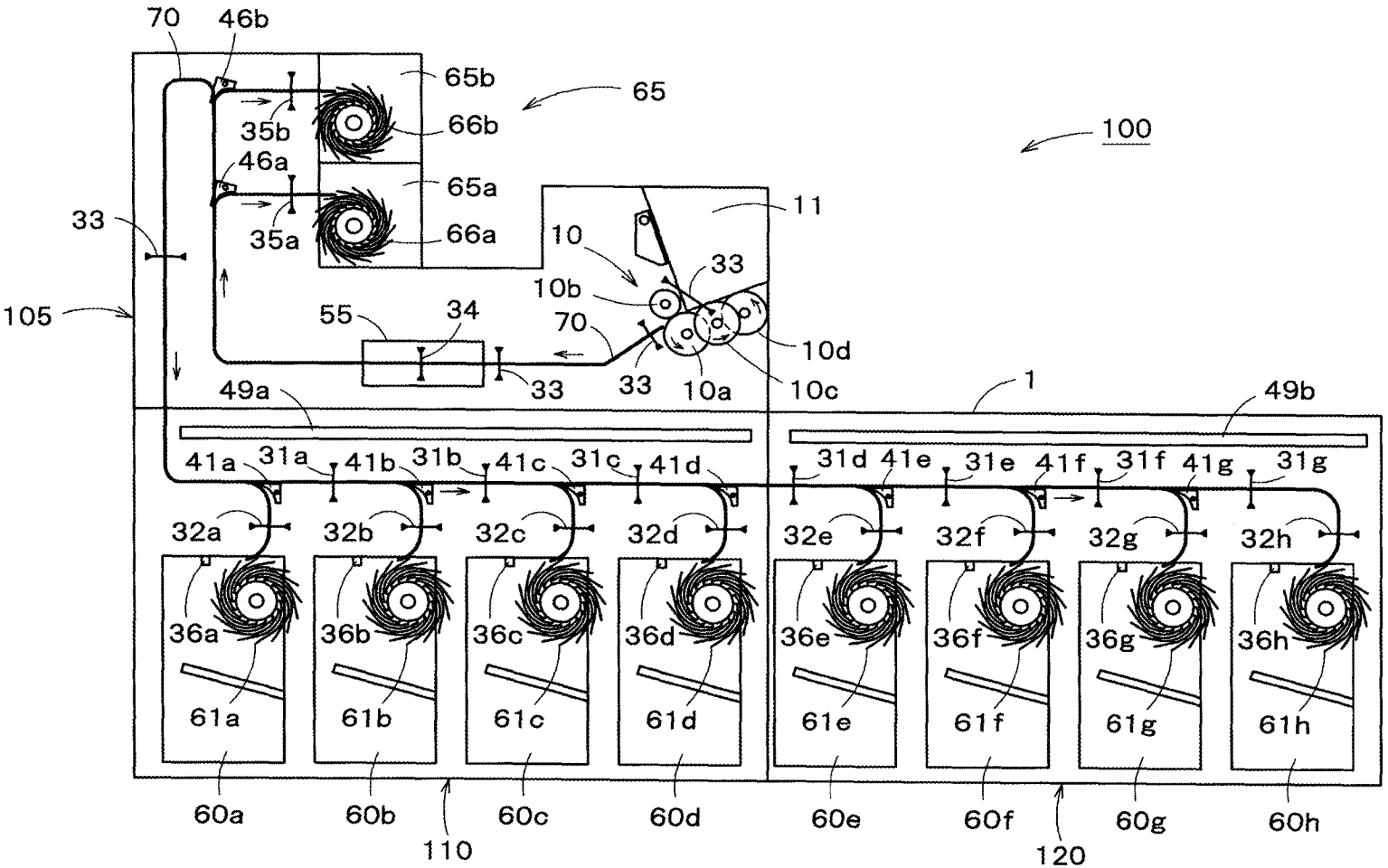
FIG. 2 is a schematic longitudinal sectional view illustrating an internal configuration of the paper sheet processing machine of the first embodiment of the present invention.

As illustrated in FIG. 1 and FIG. 2, paper sheet processing machine 100 of the present embodiment includes casing 1, reception unit 11 provided in casing 1 and configured to receive a plurality of paper sheets, and intake unit 10 configured to take the paper sheets received by reception unit 11 into casing 1 one by one. As illustrated in FIG. 2, paper sheet processing machine 100 of the present embodiment includes transport unit 70 configured to transport a paper sheet taken into casing 1 from intake unit 10 one by one, identification unit 55 configured to identify and count a paper sheet being transported by transport unit 70, and a plurality of rejection units 65 (65*a* and 65*b*) configured to reject a paper sheet which is not stacked in stacking unit 60 (60*a* to 60*h*) described later. It is to be noted that when identifying a banknote, identification unit 55 of the present embodiment identifies the denomination, fitness, face/back, printing type (new/old, etc.), orientation, authentication, serial number, and the like of the banknote, for example. It is to be noted that identification unit 55 includes image reading sensor 34 configured to read an image of a paper sheet being guided through the transport path, and identifies the denomination, fitness, face/back, printing type (new/old, etc.), orientation, authentication, serial number, and the like of a banknote based on the image data read by image reading sensor 34, for example. Examples of the currency include yen, U.S. dollar, euro, yuan, india rupee and the like. In addition, examples of the denomination of a banknote include 10,000 yen, 1,000 yen, 100 dollars, 10 dollars and the like.

As illustrated in FIG. 2, intake unit 10 includes feed roller 10*a* configured to send out a paper sheet, gate roller (reverse roller) 10*b* facing feed roller 10*a*, and kicker rollers 10*c* and 10*d* configured to kick a paper sheet housed in reception unit 11 toward feed roller 10*a*. In addition, transport unit 70 includes a transport path configured to guide a paper sheet, a transport roller and/or transport belt configured to apply a driving force to a paper sheet, and driving unit 71 configured to drive the transport roller and/or the transport belt (see FIG. 5).

Figure 6:
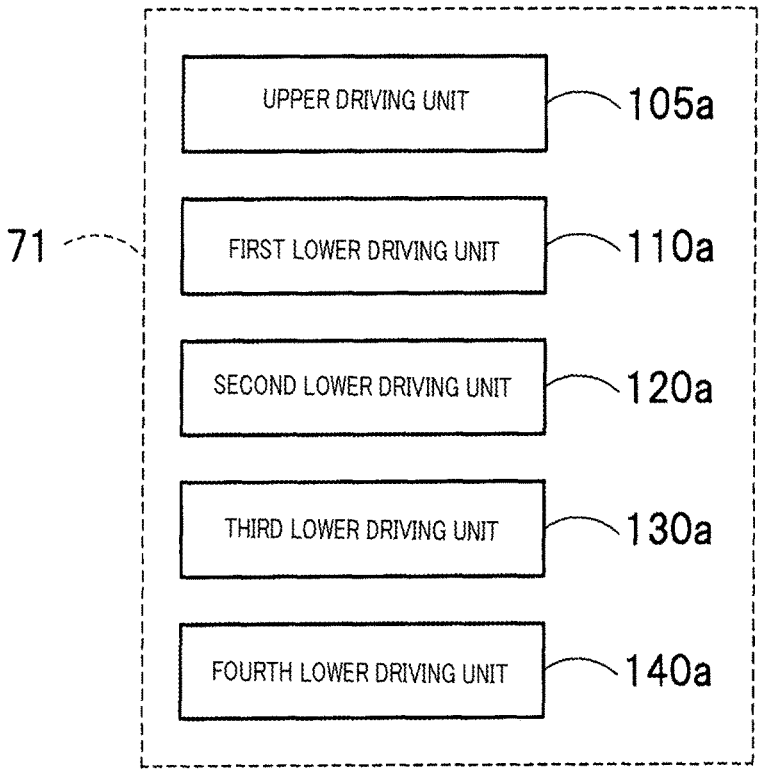
FIG. 6 illustrates a type of a driving unit used in the first embodiment of the present invention.

As illustrated in FIG. 6, driving unit 71 includes upper driving unit 105*a*, lower driving unit 110*a*, and second lower driving unit 120*a*. Upper driving unit 105*a* is provided in upper unit 105 (see FIG. 2) including reception unit 11, identification unit 55, rejection unit 65 and the like, and configured to drive transport rollers (including a feed roller, a gate roller and a kicker roller) and/or a transport belt, stacking wheels 66*a* and 66*b* and the like. First lower driving unit 110*a* is provided in first stacker unit 110 (see FIG. 2) including stacking units 60*a* to 60*d*, and configured to drive the transport roller and/or the transport belt, stacking wheels 61*a* to 61*d* and the like in the first stacker unit 110. Second lower driving unit 120*a* is provided in second stacker unit 120 (see FIG. 2) including stacking units 60*e* to 60*h*, and configured to drive the transport roller and/or the transport belt, stacking wheels 61*e* to 61*h* and the like in the second stacker unit 120.

The detail of the fitness of a paper sheet may include a first type suitable for use in external apparatuses, a second type suitable for uses other than external apparatuses, and a third type which cannot be used. In the case where the paper sheet is a banknote, the fitness of the banknote may be classified into three types: a banknote (so-called "UNFIT" banknote: which corresponds to the above-mentioned third type) which cannot be used in a banknote processing machine (a kind of external apparatuses) such as an ATM provided at a financial institution such as a bank, or at a reception of a financial institution of a bank and the like; a banknote (so-called "Teller-FIT" banknote: which corresponds to the above-mentioned second type) which cannot be used at an ATM provided at a financial institution such as a bank, but can be used at a reception of a financial institution of a bank and the like; and a banknote (so-called "ATM-FIT" banknote: which corresponds to the above-mentioned first type corresponding to) which can be used at an ATM provided at a financial institution such as a bank and a reception of a financial institution of a bank and the like. In addition, the present invention is not limited to such a configuration, and the detail of the fitness of a paper sheet may be classified into two types, a fit note and an unfit note.

As illustrated in FIG. 1 and FIG. 2, rejection unit 65 includes first rejection unit 65*a* disposed on the lower side, and second rejection unit 65*b* disposed on the upper side. For example, paper sheets which are determined to be identification abnormality and/or transport abnormality may be stacked in first rejection unit 65*a*, and paper sheets determined to be counterfeit notes by authentication of identification unit 55 may be stacked in second rejection unit 65*b*. The transport abnormality is an abnormality which is caused when a paper sheet is transported by transport unit 70. Examples of the transport abnormality include a case where a paper sheet is obliquely transported (skewing), a case where a plurality of paper sheets being transported overlap (overlapped-feeding), a case where a plurality of paper sheets are transported without a predetermined interval therebetween (chain-feeding) and the like. Examples of the identification abnormality include a case where information identified by identification unit 55 does not match identification information preliminarily stored in a storage unit such as main storage unit 56 described later, and the like.

As illustrated in FIG. 2, the transport path of transport unit 70 is provided with diverter 46 (46*a* and 46*b*) for guiding a paper sheet toward rejection unit 65. To be more specific, diverter 46*a* for guiding a paper sheet to first rejection unit 65*a*, and diverter 46*b* for guiding a paper sheet to second rejection unit 65*b* are provided.

In addition, sensor 35*a* is provided between diverter 46*a* and first rejection unit 65*a*. Sensor 35*a* detects whether a paper sheet guided by diverter 46*a* is being normally guided to first rejection unit 65*a*. Likewise, sensor 35*b* is provided between diverter 46*b* and second rejection unit 65*b*. Sensor 35*b* detects whether a paper sheet guided by diverter 46*b* is being normally guided to second rejection unit 65*b*.

As illustrated in FIG. 2, first cover 49*a* is provided at an upper part of stacking units 60*a* to 60*d* so as to cover transport unit 70 in first stacker unit 110. Likewise, second cover 49*b* is provided at an upper part of stacking units 60*e* to 60*h* so as to cover transport unit 70 in second stacker unit 120.

In addition, as illustrated in FIG. 2, paper sheet processing machine 100 of the present embodiment includes a plurality of (eight, in the configuration illustrated in FIG. 1 and FIG. 2) stacking units 60 (60*a* to 60*h*) for stacking paper sheets identified by identification unit 55. Each of stacking units 60*a* to 60*h* opens at the front face thereof, and the operator can freely take out the paper sheets in stacking units 60*a* to 60*h*. While FIG. 1 and FIG. 2 illustrate an example case where eight stacking units 60*a* to 60*h* are provided, the number of stacking units 60*a* to 60*h* may be smaller than eight or larger than eight. In addition, while each of stacking units 60*a* to 60*h* opens at the front face thereof in the present embodiment, the present invention is not limited thereto, and it is also possible to employ stacking units which are provided with no opening and completely housed in casing 1 such that the stacking units can be accessed only by opening casing 1. It is to be noted that stacking units 60*a* to 60*h* of the present embodiment are included in "stacking unit" of the claims.

As illustrated in FIG. 1, operation/display unit 59 composed of a touch panel is provided on the front face side of casing 1, for example. Operation/display unit 59 can display predetermined information, and allow input of predetermined information. While operation/display unit 59 serves as an operation unit and a display unit, the configuration of operation/display unit 59 is not limited to such a configuration. That is, it is also possible to separately provide an operation unit and a display unit. In addition, in the present embodiment, button operation unit 58 is provided adjacently to operation/display unit 59 on the front face side of casing 1.

As illustrated in FIG. 2, transport unit 70 is provided with a plurality of sensors 33 configured to detect a paper sheet passing through transport unit 70 and detect presence/absence of a paper sheet. It is to be noted that sensor 33 provided at reception unit 11 is used for detecting whether a paper sheet is present in reception unit 11. In addition, sensor 33 provided between diverter 46*b* and stacking unit 60*a* is used for detecting whether a paper sheet which has not been guided to rejection unit 65 is being normally guided toward stacking units 60*a* to 60*h*.

As illustrated in FIG. 2, sensors 31 (31*a* to 31*g*) configured to detect whether a paper sheet is being normally transported, and diverters 41 (41*a* to 41*g*) configured to switch stacking units 60*a* to 60*h* to which paper sheets are guided are provided on the transport path in first stacker unit 110 and second stacker unit 120. In addition, count sensors 32 (32*a* to 32*h*) configured to detect whether paper sheets guided by diverters 41*a* to 41*g* are being normally guided to stacking units 60*a* to 60*h* are provided on the downstream side of diverters 41*a* to 41*g*.

In addition, as illustrated in FIG. 1, individual display units 51*a* to 51*h* corresponding to stacking units 60*a* to 60*h* are provided in casing 1. Individual display units 51*a* to 51*h* display the type (that is, the sort type described later) and/or the number of paper sheets stacked in respective stacking units 60*a* to 60*h*. Each of individual display units 51*a* to 51*h* may be a display such as an LCD, or a combination of printed letters and a light emitting element. It is to be noted that the paper sheet type displayed on individual display units 51*a* to 51*h* includes, for example, the currency type, denomination of a banknote, printing type of a banknote, fitness of a paper sheet, face/back of a paper sheet, orientation of a paper sheet and the like. The orientation of a paper sheet includes face-up and portrait-up, face-up and portrait-down, face-down and portrait-up and face-down and portrait-down. To be more specific, in the case where the paper sheet is a banknote, the face-up and portrait-up is the orientation in which the portrait faces upward and the banknote is taken from the head of the portrait, the face-up and portrait-down is the orientation in which the portrait faces upward and the banknote is taken from the part opposite to the head, the face-down and portrait-up is the orientation in which the portrait faces downward and the banknote is taken from the head of the portrait, and the face-down and portrait-down is the orientation in which the portrait faces downward and the banknote is taken from the part opposite to the head. Note that, in the present embodiment, the portrait side of a banknote is referred to as front surface, and the surface opposite to the front surface is referred to as rear surface.

In addition, as illustrated in FIG. 2, remainder detection sensors 36 (36*a* to 36*h*) configured to detect the status of paper sheets housed in stacking units 60*a* to 60*h* are provided in respective stacking units 60*a* to 60*h*.

In stacking units 60*a* to 60*h* of the present embodiment, paper sheets can be stacked based on the detail of the sort type identified by identification unit 55. Here, the sort type is a type used for sorting the paper sheet, and includes the currency type, denomination of a banknote, printing type of a banknote, fitness of a paper sheet, face/back of a paper sheet, orientation of a paper sheet and the like, for example. It is to be noted that the detail of the sort type of paper sheets stacked or to be stacked in stacking units 60*a* to 60*h* may be displayed on operation/display unit 59 and/or external display unit 540 provided in external apparatus 500 (see FIG. 7 and FIG. 8) such as a management apparatus configured to manage paper sheet processing machine 100 and the like, for example. In addition, as described above, individual display units 51*a* to 51*h* illustrated in FIG. 1 may display the detail of the sort type of paper sheets stacked or to be stacked in stacking units 60*a* to 60*h*. Note that, external apparatus 500 in the present embodiment is an apparatus other than the subject apparatus, and, as viewed from paper sheet processing machine 100, any apparatus other than paper sheet processing machine 100 can be external apparatus 500, for example.

Figure 5:
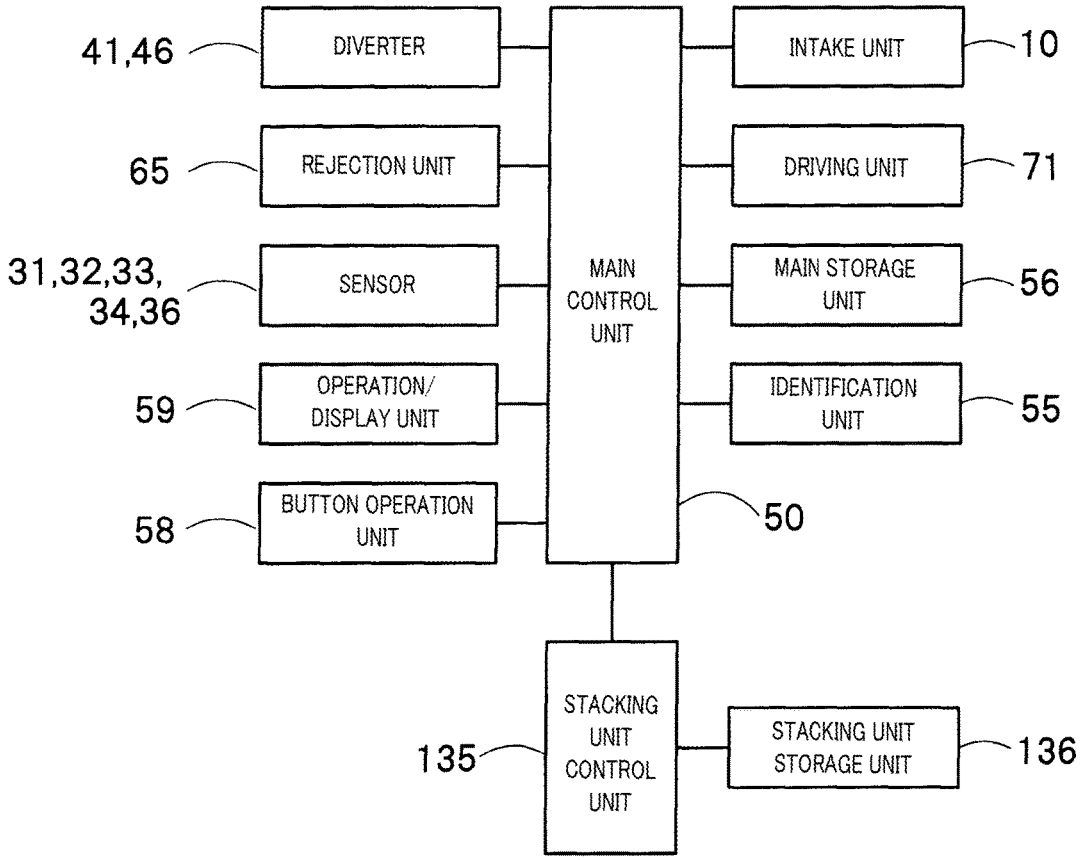
FIG. 5 is a control block diagram of the paper sheet processing machine of the first embodiment of the present invention.

In addition, as illustrated in FIG. 5, paper sheet processing machine 100 of the present embodiment also includes main storage unit 56 and main control unit 50. Main storage unit 56 stores the upper limit number of the paper sheets to be stacked in stacking units 60*a* to 60*h* linked with the detail of the sort type. Main control unit 50 reads from main storage unit 56 the upper limit number of the paper sheets corresponding to the detail of the sort type of the paper sheets to be stacked in each of stacking units 60*a* to 60*h*, and sets the upper limit number of the paper sheets to be stacked in stacking units 60*a* to 60*h*. It is to be noted that main storage unit 56 is included in "storage unit" recited in claims. In addition, main control unit 50 is included in "control unit" recited in claims.

Incidentally, the storage unit for storing the upper limit number of the paper sheets to be stacked in stacking units 60*a* to 60*h* linked with the detail of the sort type may be provided in external apparatus 500. In addition, while main control unit 50 is provided in paper sheet processing machine 100 in the present embodiment, the present invention is not limited to this, and a control unit that controls paper sheet processing machine 100 may be provided in external apparatus 500.

Figure 7:
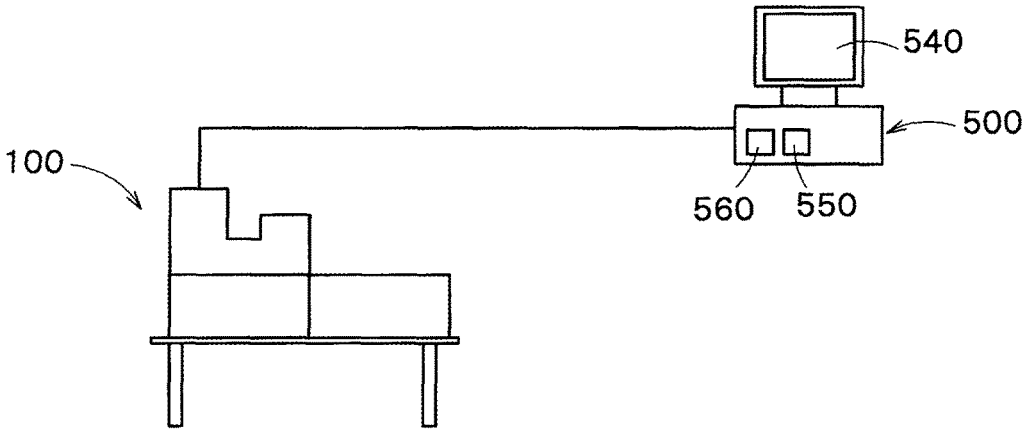
FIG. 7 is a schematic diagram illustrating an exemplary configuration of a paper sheet processing system of the first embodiment of the present invention.
Figure 8:
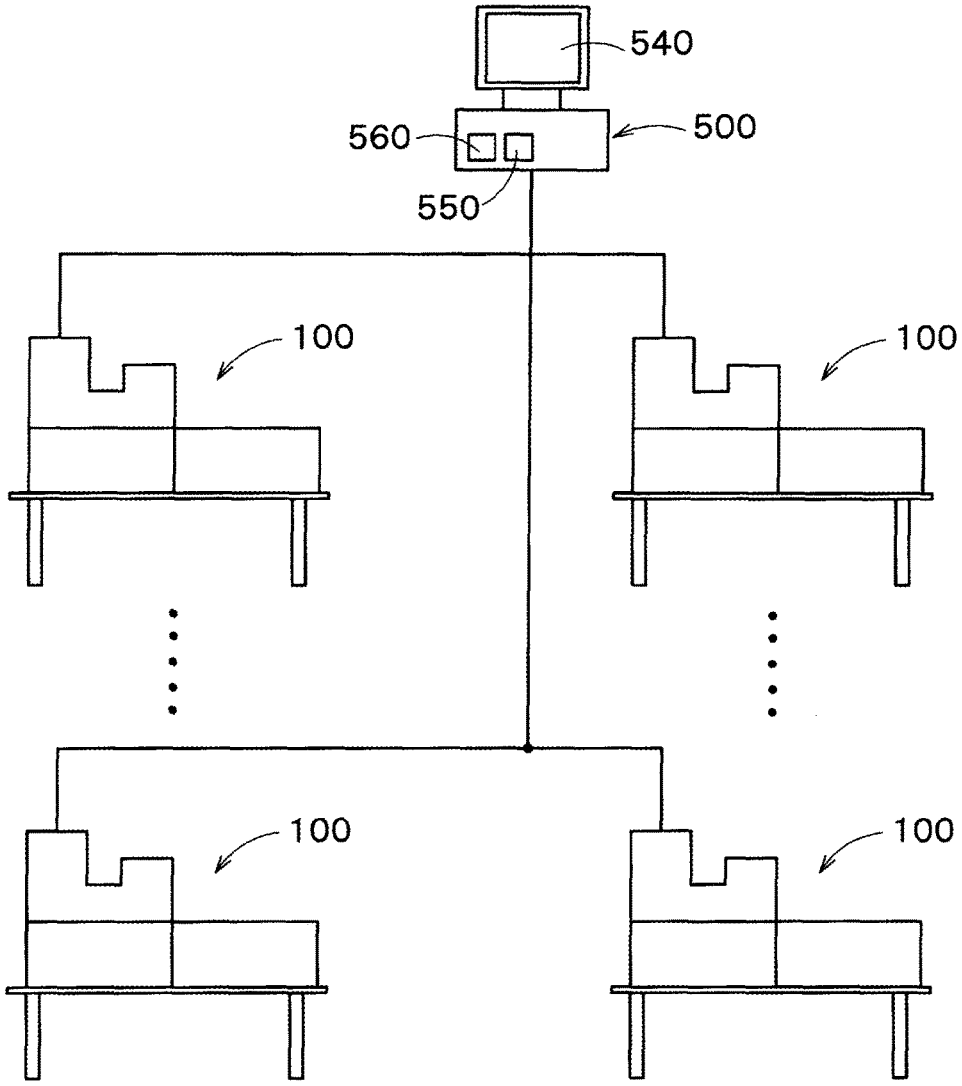
FIG. 8 is a schematic diagram illustrating another exemplary configuration of the paper sheet processing system of the first embodiment of the present invention.

For example, it is possible to employ a configuration in which paper sheet processing machine 100 includes identification unit 55 and stacking units 60*a* to 60*h*, and external apparatus 500 includes external storage unit 560 storing the upper limit number of the paper sheets to be stacked in stacking units 60*a* to 60*h* linked with the detail of the sort type, and external control unit 550 configured to read from external storage unit 560 the upper limit number of the paper sheets corresponding to the detail of the sort type of the paper sheets to be stacked in stacking units 60*a* to 60*h*, and set the upper limit number of the paper sheets to be stacked in stacking units 60*a* to 60*h* (see FIG. 7 and FIG. 8). In this case, external storage unit 560 and external control unit 550 may be provided in the same external apparatus 500, or in different external apparatuses 500. It is to be noted that external storage unit 560 is included in "storage unit" recited in claims. In addition, external control unit 550 is included in "control unit" recited in claims.

Alternatively, it is also possible to employ a configuration in which paper sheet processing machine 100 includes identification unit 55, stacking units 60*a* to 60*h* and main control unit 50, and external apparatus 500 includes external storage unit 560 storing the upper limit number of the paper sheets to be stacked in stacking units 60*a* to 60*h* linked with the detail of the sort type. It is to be noted that, in this case, main control unit 50 reads from external storage unit 560 the upper limit number of the paper sheets corresponding to the detail of the sort type of the paper sheets to be stacked in stacking units 60*a* to 60*h*, and sets the upper limit number of the paper sheets to be stacked in stacking units 60*a* to 60*h*.

Alternatively, it is also possible to employ a configuration in which paper sheet processing machine 100 includes identification unit 55, stacking units 60*a* to 60*h* and main storage unit 56, and external apparatus 500 includes external control unit 550 configured to read from main storage unit 56 the upper limit number of the paper sheets corresponding to the detail of the sort type of the paper sheets to be stacked in stacking units 60*a* to 60*h*, and set the upper limit number of the paper sheets to be stacked in stacking units 60*a* to 60*h*.

Incidentally, as illustrated in FIG. 7, one external apparatus 500 may be provided for one paper sheet processing machine 100. Alternatively, in the case where a plurality of paper sheet processing machines 100 are provided as illustrated in FIG. 8, one external apparatus 500 may be provided for a plurality of paper sheet processing machines 100.

Figure 3:
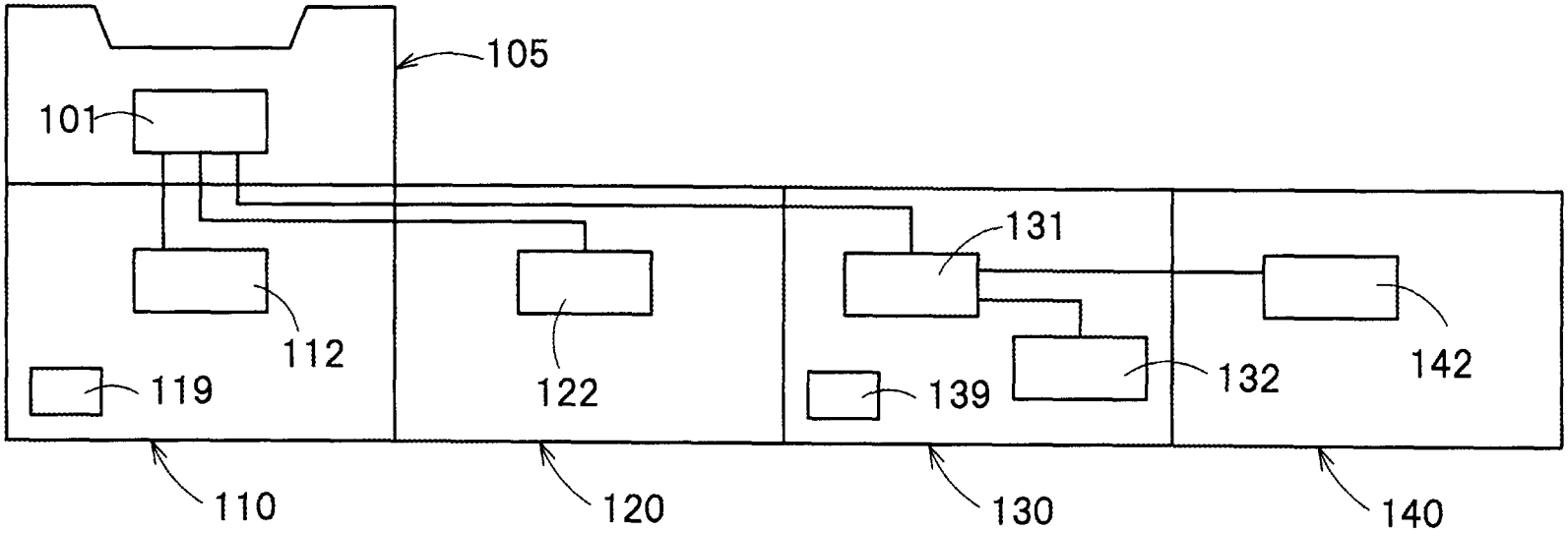
FIG. 3 schematically illustrates a configuration of a substrate installed inside the paper sheet processing machine of the first embodiment of the present invention.
Figure 4:
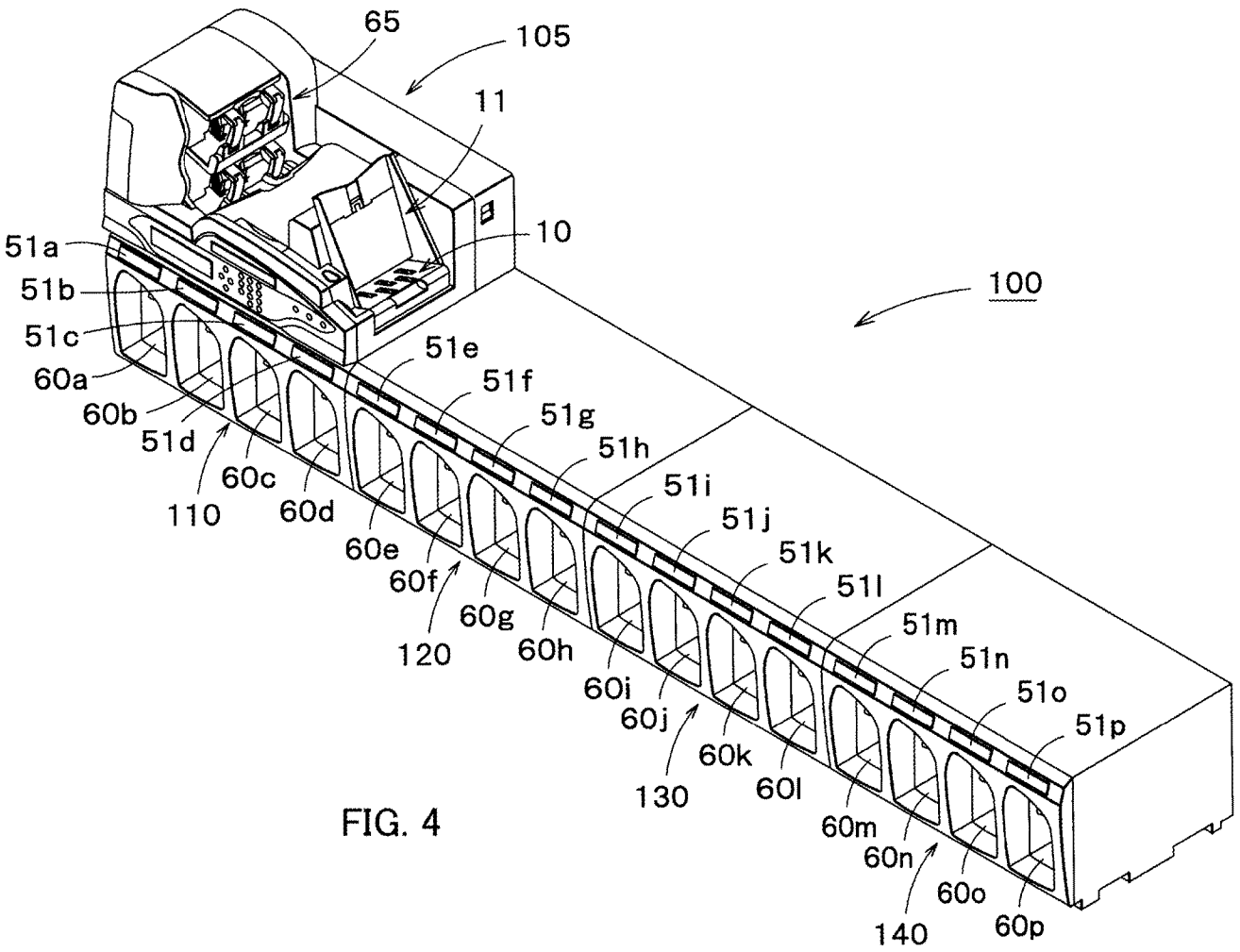
FIG. 4 illustrates a perspective view of an external appearance of a paper sheet processing machine of a modification of the first embodiment of the present invention.

FIG. 3 schematically illustrates a configuration of a substrate installed inside paper sheet processing machine 100 in an exemplary configuration in which 16 stacking units, 60*a* to 60*p*, are provided in paper sheet processing machine 100 of the present embodiment as illustrated in FIG. 4. In the configuration illustrated in FIG. 3, driving unit 71 includes third lower driving unit 130*a* and fourth lower driving unit 140*a*, in addition to upper driving unit 105*a*, first lower driving unit 110*a* and second lower driving unit 120*a*. Third lower driving unit 130*a* is provided in third stacker unit 130 including stacking units 60*i* to 60*l* (see FIG. 4), and is configured to drive the transport roller and/or the transport belt, stacking wheels 61*i* to 61*l* and the like in third stacker unit 130 (see FIG. 6). Fourth lower driving unit 140*a* is provided in fourth stacker unit 140 including stacking units 60*m* to 60*p* (see FIG. 4), and is configured to drive the transport roller and/or the transport belt, stacking wheels 61*m* to 61*n* and the like in fourth stacker unit 140 (see FIG. 6).

In addition, in the configuration illustrated in FIG. 3, power source 119 corresponding to first stacker unit 110 and second stacker unit 120 is provided in first stacker unit 110, and power source 139 corresponding to third stacker unit 130 and fourth stacker unit 140 is provided in third stacker unit 130.

It is to be noted that a third cover may be provided at an upper part of stacking units 60*i* to 60*l* illustrated in FIG. 4 so as to cover transport unit 70 in third stacker unit 130, and a fourth cover may be provided at an upper part of stacking units 60*m* to 60*p* illustrated in FIG. 4 so as to cover transport unit 70 in fourth stacker unit 140.

As illustrated in FIG. 3, paper sheet processing machine 100 of the present embodiment includes main substrate 101 including a CPU, first stacker unit driving substrate 112 connected with main substrate 101 and provided in first stacker unit 110, second stacker unit driving substrate 122 connected with main substrate 101 and provided in second stacker unit 120, third stacker unit driving substrate 132 connected with main substrate 101 with stacking unit substrate 131 therebetween and provided in third stacker unit 130, and fourth stacker unit driving substrate 142 provided in fourth stacker unit 140 and connected with main substrate 101 through stacking unit substrate 131 therebetween. It is to be noted that stacking unit substrate 131 includes CPU, and is provided in third stacker unit 130.

First stacker unit driving substrate 112 drives first lower driving unit 110*a* and the like in response to a command from main substrate 101. Second stacker unit driving substrate 122 drives second lower driving unit 120*a* and the like in response to a command from main substrate 101. Third stacker unit driving substrate 132 drives third lower driving unit 130*a* and the like in response to a command from stacking unit substrate 131 (or main substrate 101). Fourth stacker unit driving substrate 142 drives fourth lower driving unit 140*a* and the like in response to a command from stacking unit substrate 131 (or main substrate 101).

It is to be noted that stacking unit substrate 131 includes stacking unit storage unit 136 and stacking unit control unit 135. Stacking unit storage unit 136 stores various information such as the number of paper sheets stacked in stacking units 60*i* to 60*l* and stacking units 60*m* to 60*p*, the sort type of the paper sheets and the like (see FIG. 5). Stacking unit control unit 135 controls third stacker unit driving substrate 132, fourth stacker unit driving substrate 142 and the like (see FIG. 5).

Stacking unit storage unit 136 is included in "storage unit" recited in claims, and stacking unit control unit 135 is included in "control unit" recited in claims.

In response to a command from main substrate 101, stacking unit substrate 131 transmits a command to third stacker unit driving substrate 132 and fourth stacker unit driving substrate 142 based on the command. In addition, information such as the number of paper sheets stacked in stacking units 60*i* to 60*l* and stacking units 60*m* to 60*p*, the sort type of the paper sheets and the like are acquired by stacking unit substrate 131, and transmitted to main substrate 101 from the stacking unit substrate 131.

In the following descriptions, the terms "storage units 56, 136 and 560" refer to at least one of main storage unit 56, stacking unit storage unit 136 and external storage unit 560, and the terms "control units 50, 135 and 550" refer to at least one of main control unit 50, stacking unit control unit 135 and external control unit 550. In the following descriptions of the present embodiment, unless otherwise noted, the paper sheet processing machine (see FIG. 1 and FIG. 2) includes eight stacking units 60*a* to 60*h*.

In the present embodiment, the upper limit number of the paper sheets to be stacked in stacking units 60*a* to 60*h* corresponding to the detail of the sort type of the paper sheets can be freely set. Accordingly, in the case where the detail of the sort type of the paper sheets to be stacked in one of stacking units 60*a* to 60*h* are different from the detail of the sort type of the paper sheets to be stacked in another of stacking units 60*a* to 60*h*, the upper limit number of the paper sheets to be stacked in the one of stacking units 60*a* to 60*h* may be set to a value different from the upper limit number of the paper sheets to be stacked in the other of stacking units 60*a* to 60*h*.

In an exemplary configuration, storage units 56, 136 and 560 store the upper limit number of the paper sheets to be stacked in stacking units 60*a* to 60*h* respectively linked with a plurality of details of the first sort type (which is one of a plurality of sort types). In the case where paper sheets are stacked based on different details of the first sort type, the upper limit number of sheets is set based on the details of the first sort type. Incidentally, in some situation, the details identical with each other in a second sort type (which is one of a plurality of sort types) can be set to at least two or more stacking units 60*a* to 60*h* that stack paper sheets based on different details of the first sort type. It is to be noted that, for example, the first sort type is the fitness of a banknote, and the second sort type is the denomination of a banknote.

In addition, in the case where the detail of the sort type of the paper sheets to be stacked in one of stacking units 60*a* to 60*h* is changed, the upper limit number of the paper sheets to be stacked in the one of stacking units 60*a* to 60*h* can be reset based on the changed sort type which is set anew.

On the basis of the detail of the sort type of the paper sheets identified by identification unit 55, control units 50, 135 and 550 may read from storage units 56, 136 and 560 the upper limit number of the paper sheets corresponding to the detail of the sort type of the paper sheets, and set the upper limit number of the paper sheets to be stacked in stacking units 60*a* to 60*h* to which the paper sheets are transported. For example, on the basis of the detail of the sort type of the paper sheets identified by identification unit 55, control units 50, 135 and 550 determine whether a stacking unit of stacking units 60*a* to 60*h* for stacking the paper sheets of that detail of the sort type is already determined, and, when the stacking unit of stacking units 60*a* to 60*h* for stacking the paper sheets of that detail of the sort type is already determined, transport the paper sheets to the stacking unit. On the other hand, when a stacking unit of stacking units 60*a* to 60*h* for stacking the paper sheets of that detail of the sort type is not determined, it is possible to determine the stacking unit of stacking units 60*a* to 60*h* to which the paper sheet is transported and read, from storage units 56, 136 and 560, the upper limit number of the paper sheets corresponding to that detail of the sort type of the paper sheets, and, set the upper limit number of the paper sheets to be stacked in the stacking unit of stacking units 60*a* to 60*h* to which the paper sheets are transported. It is to be noted that, in the case where the destination of the paper sheet is determined based on the detail of the sort type of the paper sheets identified by identification unit 55, the "automatic determination mode" or the "dynamic determination mode" described later is used.

In addition, the present invention is not limited to such a configuration, and the detail of the sort type of the paper sheets to be stacked in stacking units 60*a* to 60*h* may be set in advance (see "designation mode" described later). In this case, control units 50, 135 and 550 may read from storage units 56, 136 and 560 the upper limit number of the paper sheets corresponding to the detail of the sort type of the paper sheets based on the detail of the sort type set in advance, and set the upper limit number of the paper sheets to be stacked in stacking units 60*a* to 60*h*.

In addition, paper sheet processing machine 100 of the present embodiment may be switchable to a changing mode for changing the upper limit number of the paper sheets to be stacked in stacking units 60*a* to 60*h*. The upper limit number of sheets linked with the detail of the sort type of the paper sheets is stored in storage units 56, 136 and 560. By switching the mode to the changing mode, it is possible to set the upper limit number of the paper sheets to be stacked in stacking units 60*a* to 60*h* for each of the details of at least one of the sort types, namely, the currency type, denomination of a banknote, printing type of a banknote, fitness of a paper sheet, face/back of a paper sheet and orientation of a paper sheet. Here, an case is conceivable in which the detail is set for each of different sort types in one of stacking units 60*a* to 60*h*, and the upper limit numbers of sheets linked with the set details of the sort types are different from each other. In this case, the upper limit number of sheets can be uniquely determined by setting the upper limit number to an upper limit number of sheets linked with a highly prioritized sort type, or to a maximum upper limit number of sheets, or, to a minimum upper limit number of sheets. Alternatively, it is possible to set the upper limit number of sheets to an upper limit number of sheets linked with the sort type selected by the operator.

Here, an allocation mode of paper sheets to be stacked in stacking units 60*a* to 60*h* is described below.

The allocation mode is a mode for allocating paper sheets to stacking units 60*a* to 60*h*, and includes a designation mode, an automatic determination mode, a dynamic determination mode, a mixture mode and a non-designation mode. Stacking units 60*a* to 60*h* can be set to the designation mode, the automatic determination mode, the dynamic determination mode, the mixture mode or the non-designation mode for each of the currency type, denomination of a banknote, printing type of a banknote, fitness of a paper sheet, face/back of a paper sheet and orientation of a paper sheet. The priority decreases in the order of the designation mode, the automatic determination mode, the dynamic determination mode, the mixture mode and the non-designation mode, and Table 1 shows the priority (the larger the number, the higher the priority).

TABLE 1

| Allocation mode | Priority |
|---|---|
| Designation mode | 5 |
| Automatic determination mode | 4 |
| Dynamic determination mode | 3 |
| Mixture mode | 2 |
| Non-designation mode | 1 |

The designation mode is a mode for preliminarily designating the detail of the sort type of the paper sheets to be stacked in stacking units 60*a* to 60*h*. For example, when the currency is set by the designation mode, one of U.S. dollar, yen, euro and the like is designated from operation/display unit 59 and the like. In addition, when the denomination is set by the designation mode, it is required to set the currency by the designation mode in advance to designate the currency to be stacked in stacking units 60*a* to 60*h* to be set. For example, when the denomination is set by the designation mode to designate 100 dollars, the currency is set by the designation mode in advance to designate U.S. dollar. Alternatively, it is also possible that, when the denomination is set by the designation mode, the currency to which the set denomination belongs is automatically set.

Next, the following describes a first automatic determination mode, a second automatic determination mode, a third automatic determination mode . . . , and n-th automatic determination mode for allocating the paper sheets to be stacked in stacking units 60*a* to 60*h* based on an identification result of identification unit 55 during the processing of paper sheets. In the first automatic determination mode, the detail of the sort type firstly identified by identification unit 55 in a processing of paper sheets for one transaction is set as the detail of the paper sheets to be stacked in corresponding stacking unit of stacking units 60*a* to 60*h*. For example, in the case where the first automatic determination mode is set for the currency for stacking unit 60*a*, and the banknote firstly identified by identification unit 55 is euro banknote, euro is assigned to stacking unit 60*a*, and thereafter, the banknote identified as an euro banknote is transported to stacking unit 60*a* and stacked in stacking unit 60*a*.

In addition, in the case where, for stacking unit 60*a*, the designation mode is set for the currency and U.S. dollar is designated, and, the first automatic determination mode is set for the denomination, the denomination of a U.S. dollar banknote firstly identified by identification unit 55 is assigned to stacking unit 60*a*. For example, when the U.S. dollar banknote firstly identified by identification unit 55 is 100 dollars, 100 dollars is assigned to stacking unit 60*a*.

In the second automatic determination mode, the detail of the sort type secondly identified by identification unit 55 is set as the detail of the paper sheets to be stacked in corresponding stacking unit of stacking units 60*a* to 60*h* in a processing of paper sheets for one transaction. For example, in the case where the first automatic determination mode is set for the currency for stacking unit 60*a* and the second automatic determination mode is set for the currency for stacking unit 60*b*, and the banknote firstly and secondly identified by identification unit 55 is an euro banknote and a U.S. dollar, respectively, euro is assigned to stacking unit 60*a* as the currency, and U.S. dollar is assigned to stacking unit 60*b* as the currency.

In the third automatic determination mode, the detail of the sort type thirdly identified by identification unit 55 is set as the detail of the paper sheets to be stacked in corresponding stacking unit of stacking units 60*a* to 60*h* in a processing of paper sheets for one transaction. Further, it is possible to set a fourth automatic determination mode, a fifth automatic determination mode . . . , n-th automatic determination mode and the like.

As shown in Table 1, the priority of the automatic determination mode is high next to the designation mode. Accordingly, when there is a detail of the sort type designated by the designation mode, the detail of the sort type other than the detail of the sort type designated by the designation mode is determined by the automatic determination mode. For example, in the case where the designation mode is set for the currency for stacking unit 60*a* and U.S. dollar is designated, the first automatic determination mode is set for the currency for stacking unit 60*b*, and, in the case where the banknote firstly identified by identification unit 55 is the U.S. dollar banknote, U.S. dollar banknotes are transported to stacking unit 60*a*. Then, among currencies other than the U.S. dollar banknote, the currency firstly identified by identification unit 55 is determined as the currency to be stacked in stacking unit 60*b*.

It is to be noted that the automatic determination mode can be set for a plurality of stacking units of stacking units 60*a* to 60*h*. For example, in the case where the first automatic determination mode is set for the currency for stacking unit 60*a* and stacking unit 60*b* and the banknote firstly identified by identification unit 55 is an euro banknote, euro is assigned as the currency to be stacked in stacking unit 60*a* and stacking unit 60*b*. The detail of the sort type assigned by the automatic determination mode for stacking units 60*a* to 60*h* may be cleared when the processing of the banknote of one transaction is completed.

Next, the dynamic determination mode is described. The dynamic determination mode is a mode for allocating the paper sheets to be stacked in stacking units 60*a* to 60*h* based on an identification result of identification unit 55 during the processing of paper sheets, and can assign paper sheets regardless of the order of the paper sheet unlike the automatic determination mode. In the case where the type of the identified paper sheet is not assigned to any of stacking units 60*a* to 60*h*, and there is a stacking unit to which the dynamic determination mode is set in stacking units whose allocation is not determined in stacking units 60*a* to 60*h*, the identified detail of the sort type is assigned to that stacking unit. For example, in the case where an india rupee is identified by identification unit 55 in the state where the dynamic determination mode is set for the currency for stacking unit 60*h* and dollars and euro are assigned to the currency to be stacked in stacking units 60*a* to 60*g*, india rupee is assigned to the currency to be stacked in stacking unit 60*h*.

The dynamic determination mode includes a first dynamic determination mode, a second dynamic determination mode (so-called dynamic stacking unit), and a third dynamic determination mode (so-called dynamic all).

In the first dynamic determination mode, information relating to the detail of the sort type for stacking in stacking units 60*a* to 60*h* is held until the processing of paper sheets for one transaction is completed, and is cleared when the processing of paper sheets for one transaction is completed. In the second dynamic determination mode, information relating to the sort type for stacking in one of stacking units 60*a* to 60*h* is cleared when the processing of paper sheets for one transaction is completed or when all paper sheets are pulled out from the stacking unit (one of stacking units 60*a* to 60*h*) which is set to the second dynamic determination mode. In the third dynamic determination mode, information relating to the sort type for stacking in stacking units 60*a* to 60*h* is cleared, when the processing of paper sheets for one transaction is completed or when all paper sheets are pulled out from all stacking units of stacking units 60*a* to 60*h* which are set to the third dynamic determination mode. For example, in the case where an euro banknote is identified by identification unit 55 in the state where the third dynamic determination mode is set for the currency for stacking units 60*f* to 60*h* and U.S. dollar is assigned as the currency for stacking units 60*a* to 60*e*, euro is assigned as the currency to be stacked in stacking units 60*f* to 60*h*. The details of the sort type assigned to stacking units 60*f* to 60*h* are cleared when the processing of paper sheets for one transaction is completed or when all paper sheets are pulled out from stacking units 60*f* to 60*h*.

Next, the mixture mode is described. The mixture mode is a mode for stacking paper sheets regardless of the detail of the sort type. The priority of the mixture mode is lower than that of the dynamic determination mode. Accordingly, the paper sheets of the detail of the sort type other than the detail of the sort type determined by at least one of the designation mode, the automatic determination mode and the dynamic determination mode are stacked in a mixed state in stacking units 60*a* to 60*h* set to the mixture mode.

Next, the non-designation mode is described. The priority of the non-designation mode is lowest, and paper sheets which are not stacked in the other stacking units are stacked in the stacking unit set to the non-designation mode in stacking unit 60*a* to 60*h*.

Incidentally, as illustrated in FIG. 5, main control unit 50 is connected with intake unit 10, driving unit 71, main storage unit 56, identification unit 55, diverters 41 and 46, rejection unit 65, sensors 31 to 34 and 36, operation/display unit 59, button operation unit 58, stacking unit control unit 135, stacking unit storage unit 136 and the like. With this configuration, main control unit 50 acquires information from the components connected with main control unit 50, and transmits a command to the components.

Unlike the above-described configuration, it is possible to provide paper sheet bundling unit 200 including a plurality of bundling escrow units 210 (210*a* to 210*c*) for stacking a plurality of paper sheets to be bundled which are transported by transport unit 70, and bundling unit 250 configured to bundle the paper sheets stacked in bundling escrow units

Figure 9:
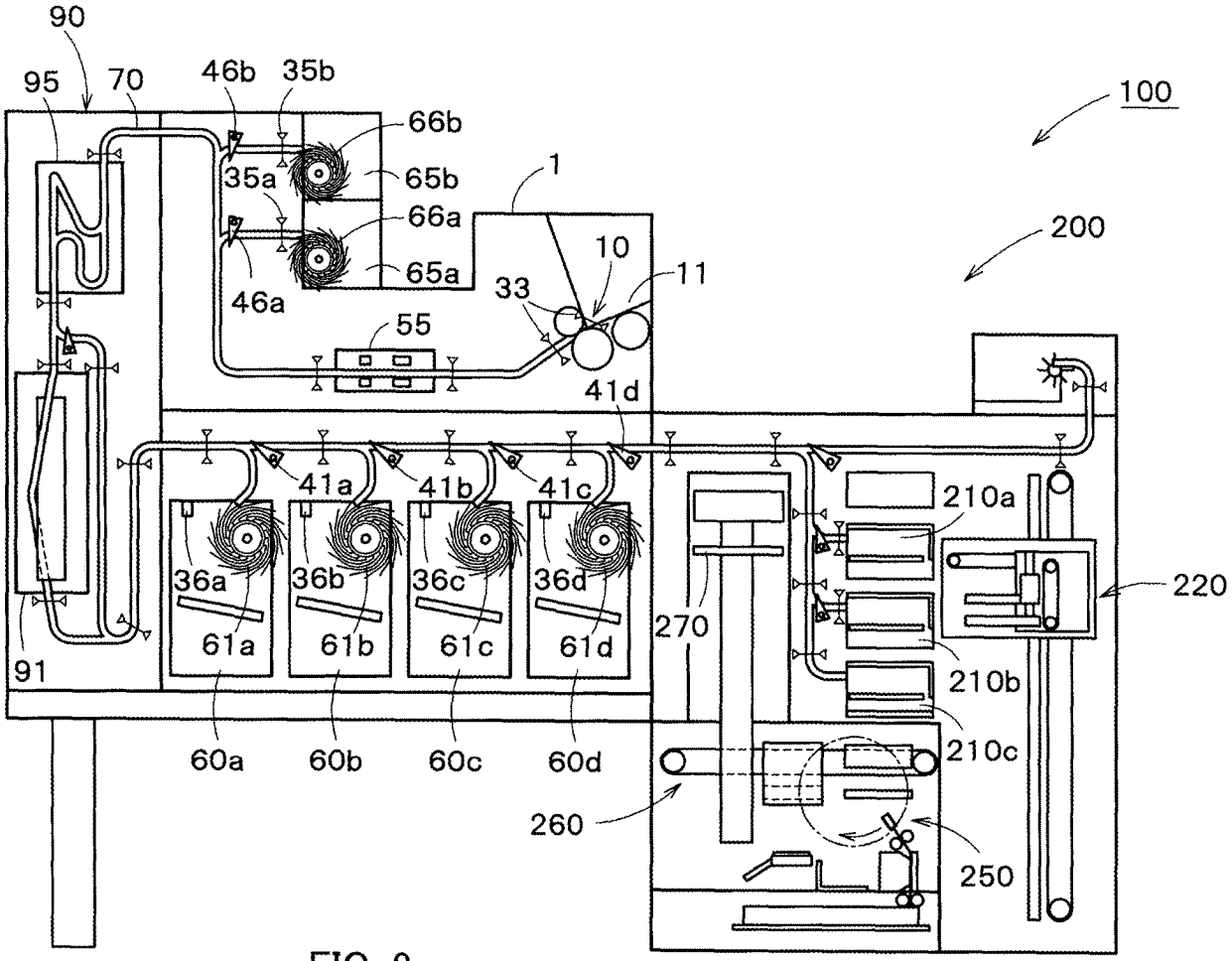
FIG. 9 is a schematic longitudinal sectional view illustrating a configuration of a paper sheet processing machine of another modification of the first embodiment of the present invention.

210*a* to 210*c* with a bundling belt to generate a paper sheet batch as illustrated in FIG. 9. In this case, bundling escrow units 210*a* 210 are also included in "stacking unit" recited in claims. Paper sheet bundling unit 200 also includes pre-bundling transport unit 220 for transporting the paper sheets to be bundled from bundling escrow units 210*a* to 210*c* to bundling unit 250, post-bundling transport unit 260 for transporting a batch of paper sheets from bundling unit 250, and paper sheet batch stacking unit 270 for housing a bundled batch of paper sheets transported by post-bundling transport unit 260. It is to be noted that the batch of paper sheets housed in paper sheet batch stacking unit 270 can be ejected by paper sheet batch stacking unit 270 from a batch ejection unit (not illustrated). It is to be noted that, while the paper sheets stacked in bundling escrow units 210*a* to 210*c* are transported to bundling unit 250 by pre-bundling transport unit 220 in the configuration illustrated in FIG. 9, the present invention is not limited to such a configuration, and it is possible to directly bundle the paper sheets stacked in bundling escrow units 210*a* to 210*c* by the bundling unit.

In addition, as illustrated in FIG. 9, paper sheet processing machine 100 of the present embodiment may include paper sheet inversion unit 90 including paper sheet inversion units 91 and 95 configured to invert a paper sheet. Paper sheet inversion units 91 and 95 include short-edge inversion unit 95 and longitudinal inversion unit 91. Short-edge inversion unit 95 is configured to invert, between face and back, a paper sheet being transported such that the orientation of the short-edge direction is changed to the opposite orientation when a paper sheet is transported by transport unit 70 in the short-edge direction. Longitudinal inversion unit 91 is configured to invert, between face and back, a paper sheet being transported by transport unit 70 such that the orientation of the longitudinal direction is changed to the opposite orientation. It is to be noted that the details of the way for inverting a paper sheet with short-edge inversion unit 95 and longitudinal inversion unit 91 are disclosed in WO2010/097954, and therefore the detailed description the thereof is omitted.

(Method)

Next, a paper sheet processing method using paper sheet processing machine 100 or the paper sheet processing system of the present embodiment is described. While the stacking unit is stacking units 60*a* to 60*h* in the following descriptions, the present invention is not limited to this, and the stacking unit may be bundling escrow units 210*a* to 210*c*, or both of stacking units 60*a* to 60*h* and bundling escrow units 210*a* to 210*c*.

First, a paper sheet to be processed is placed on reception unit 11 (see FIG. 1 and FIG. 2). Next, a paper sheet placed on reception unit 11 is taken by intake unit 10 into casing 1. A paper sheet taken by intake unit 10 is transported by transport unit 70, and identified and counted by identification unit 55, and thereafter, transported toward stacking units 60*a* to 60*h* for stacking the sheet. It is to be noted that a paper sheet which has not been normally identified by identification unit 55 is transported as a rejected paper sheet toward rejection units 65*a* and 65*b*, for example.

When a paper sheet is identified by identification unit 55, identification unit 55 identifies the detail of at least one of the sort types of the paper sheets, namely, the currency type, denomination of a banknote, printing type of a banknote, fitness of a paper sheet, face/back of a paper sheet and orientation of a paper sheet. Then, paper sheets are transported to respective stacking units 60*a* to 60*h* based on the detail of the sort type.

In the present embodiment, the upper limit number of the paper sheets to be stacked in each of stacking units 60*a* to 60*h* linked with the detail of the sort type is stored in storage units 56, 136 and 560. The upper limit numbers of the paper sheets corresponding to the details of the sort types of the paper sheets to be stacked in stacking units 60*a* to 60*h* are read from storage units 56, 136 and 560, and the upper limit numbers of the paper sheets to be stacked in respective stacking units 60*a* to 60*h* are set.

The details of the sort type corresponding to stacking units 60*a* to 60*h* may be set in advance (see the "designation mode"). Alternatively, it also is possible to determine, based on a result of reading by identification unit 55 of the details of the sort type, stacking units 60*a* to 60*h* to which the paper sheets identified by identification unit 55 are transported (see the "automatic determination mode" and the "dynamic determination mode"). In the case where the details of the sort type corresponding to stacking units 60*a* to 60*h* are set in advance, control units 50, 135 and 550 read from storage units 56, 136 and 560 the upper limit number of the paper sheet corresponding to the detail of the sort type of the paper sheet, and set the upper limit number of the paper sheet to be stacked in stacking units 60*a* to 60*h*. In the case where the details of the sort type corresponding to stacking units 60*a* to 60*h* are not set in advance, control units 50, 135 and 550 determine, based on the detail of the sort type of the paper sheet identified by identification unit 55, whether the stacking unit of stacking units 60*a* to 60*h* corresponding to the detail of the sort type of the paper sheet is already determined. When the stacking unit of stacking units 60*a* to 60*h* corresponding to the detail of the sort type of the paper sheet is already determined, the paper sheet is transported to the stacking unit of stacking units 60*a* to 60*h*. When the stacking unit of stacking units 60*a* to 60*h* corresponding to the detail of the sort type of the paper sheet is not determined, the stacking unit of stacking units 60*a* to 60*h* to which the paper sheets is to be transported is determined by control units 50, 135 and 550, and the upper limit number of the paper sheets corresponding to the detail of the sort type of the paper sheet is read from storage units 56, 136 and 560, and, the upper limit number of the paper sheet to be stacked in the stacking unit of stacking units 60*a* to 60*h* to which the paper sheets are transported is set.

Here, the following describes an exemplary case where the "designation mode" is employed for the denomination, which is a sort type, and the "automatic determination mode" is employed for the fitness, which is a sort type. It is to be noted that, in the following exemplary configuration, the detail of the fitness of a paper sheet is classified into a fit note and an unfit note.

A further detailed example is described below in which 5 euro is designated by the "designation mode" for the denomination of the paper sheets to be stacked in stacking units 60*a* to 60*h*, the first automatic determination mode is employed for the fitness of the paper sheet to be stacked in stacking units 60*a* to 60*d*, and the second automatic determination mode is employed for the fitness of the paper sheet to be stacked in stacking units 60*e* to 60*h*. Here, the detail of the fitness of is not set in stacking units 60*a* to 60*h*. In an example case where a fit note of a 5 euro banknote is firstly transported, and an unfit note of a 5 euro banknote is transported secondly or later, the fit note is set as the detail of the fitness of stacking units 60*a* to 60*d* such that fit notes of 5 euro are stacked in stacking units 60*a* to 60*d*, and the unfit note is set as the detail of the fitness of stacking units 60*e* to 60*h* such that unfit notes of 5 euro are stacked in stacking units 60*e* to 60*h*. In an example case where the upper limit number of fit notes is set to 500, and the upper limit number of unfit notes is set to 100, the upper limit number of stacking units 60*a* to 60*d* is set to 500, and the upper limit number of stacking units 60*e* to 60*h* is set to 100. In addition, also in the case where the upper limit number is set for 5 euro which is the detail of the denomination, and the upper limit number for the fitness is prioritized in comparison with the upper limit number for the denomination, the upper limit number identical to the above-mentioned upper limit number is set for each of stacking units 60*a* to 60*h*.

(Effect)

Next, other effects or particularly important effects achieved with the present embodiment having the above-mentioned configuration are described. It is to be noted that, while the stacking unit is stacking units 60*a* to 60*h* also in the following descriptions, the present invention is not limited to this. The stacking unit may be bundling escrow units 210*a* to 210*c*, and similar effect can be achieved also with such a configuration.

According to the present embodiment, the upper limit number of paper sheets corresponding to the detail of the sort type (for example, the currency type, denomination of a banknote, printing type of a banknote, fitness of a paper sheet, face/back of a paper sheet or orientation of a paper sheet) of the paper sheets to be stacked in stacking units 60*a* to 60*h* is read from storage units 56, 136 and 560, and the upper limit number of the paper sheets to be stacked in stacking units 60*a* to 60*h* is set. With this configuration, the upper limit number of the paper sheets to be stacked in stacking units 60*a* to 60*h* can be set in accordance with the detail of the sort type of the paper sheets.

In addition, in the present embodiment, the upper limit number of the paper sheets to be stacked in stacking units 60*a* to 60*h* corresponding to the detail of the sort type of the paper sheets can be freely set. With this configuration, even in the case where the detail of the first sort type of paper sheets to be stacked in two of a plurality of stacking units 60*a* to 60*h* are identical to each other, the upper limit number of the paper sheets to be stacked in one of the stacking units can be set to a value different from that of the upper limit number of the paper sheets to be stacked in the other of the stacking units when the detail of the second sort type of the paper sheets to be stacked in the one of stacking units 60*a* to 60*h* is different from the detail of the second sort type of the paper sheets to be stacked in the other of stacking units 60*a* to 60*h*.

In addition, in the present embodiment, in the case where the upper limit number of the paper sheets corresponding to the detail of the sort type of the paper sheets is read from storage units 56, 136 and 560 based on the detail of the sort type of the paper sheets identified by identification unit 55 during the processing of paper sheets, and the upper limit number of the paper sheets to be stacked in a stacking unit of stacking units 60*a* to 60*h* to which the paper sheets are to be transported is set, the upper limit number corresponding to the detail of the sort type can be set to a predetermined stacking unit of stacking units 60*a* to 60*h* in accordance with the detail of the sort type of the paper sheets actually included in a transaction. With this configuration, a situation where stacking units 60*a* to 60*h* include a stacking unit in which no paper sheet is stacked can be prevented as much as possible, and the upper limit number of the paper sheets to be stacked in stacking units 60*a* to 60*h* can be set in accordance with the detail of the sort type. It is to be noted that this configuration is mainly used in the case where the detail of the sort type for stacking in stacking units 60*a* to 60*h* is determined based on the detail of the sort type identified by identification unit 55 as in the cases of the "automatic determination mode" and the "dynamic determination mode."

Note that, in the case where the number of the paper sheets to be stacked in each of stacking units 60*a* to 60*h* is set in advance totally regardless of the detail of the sort type of the paper sheets unlike the present embodiment, the upper limit number of the paper sheets to be stacked cannot be changed in accordance with the detail of the sort type in the "automatic determination mode" or the "dynamic determination mode." The reason for this is that, when the "automatic determination mode" or the "dynamic determination mode" is employed, the paper sheets of the detail of the sort type to be stacked in each of stacking units 60*a* to 60*h* are not determined in advance. In contrast, the present embodiment is advantageous in that, even when the "automatic determination mode" or the "dynamic determination mode" is employed, the upper limit number of the paper sheets to be stacked can be changed in accordance with the detail of the sort type.

In addition, as described above, the detail of the sort type of the paper sheets to be stacked in stacking units 60*a* to 60*h* may be set in advance (see the "designation mode"). In this case, the upper limit number of the paper sheets corresponding to the detail of the sort type of the paper sheets is read from storage units 56, 136 and 560 based on the detail of the sort type set in advance, and the upper limit number of the paper sheets to be stacked in stacking units 60*a* to 60*h* is set. With such a configuration, it is possible to preliminarily determine the stacking unit of stacking units 60*a* to 60*h* corresponding to the detail of the sort type of paper sheets to be stacked, and it is possible to set the upper limit number of the paper sheets to be stacked in the stacking unit of stacking units 60*a* to 60*h*.

In the case where the sort type of the paper sheets is currency, the upper limit number of the paper sheets to be stacked can be set with respect to a predetermined currency such as yen, U.S. dollar, euro, yuan, india rupee and the like as the detail of the sort type. For example, the upper limit number of banknotes to be stacked in stacking unit 60*h* can be set to 100 banknotes of euro of mixed denominations.

In addition, in the case where the sort type is denomination, the upper limit number of the paper sheets to be stacked can be set with respect to denominations such as 10,000 yen, 1,000 yen, 100 dollars, 10 dollars, 100 euro, and 10 euro as the detail of the sort type. For example, the upper limit number of banknotes to be stacked in stacking unit 60*a* can be set to 300 notes of 1,000 yen.

In addition, in the case where the sort type is the printing type of a banknote, the upper limit number of the paper sheets to be stacked can be set for new note and/or old note and the like as the detail of the sort type. For example, the upper limit number of banknotes to be stacked in stacking unit 60*b* can be set to 500 new notes of 100 U.S. dollars. Alternatively, the upper limit number of banknotes to be stacked in stacking unit 60*h* can be set to 100 old notes of mixed currency and denomination.

In addition, in the case where the sort type is the fitness of a paper sheet, the upper limit number of the paper sheets to be stacked can be set with respect to the detail of the sort type. The detail of the sort type of the fitness may include the first type suitable for use in external apparatus 500, the second type suitable for uses other than the use in external apparatus 500, and a third type which cannot be used. With such a configuration, paper sheets can be sorted into three types by the degree of damage and the like, and, the upper limit number of sheets to be stacked in stacking units 60*a* to 60*h* can be set based on the three types.

In addition, when the fitness of a paper sheet is sorted into three types, the upper limit number of sheets set for the first type (for example, "ATM-FIT") may be greater than the upper limit number of sheets set for the second type (for example, "Teller-FIT") and/or the upper limit number of sheets set for the third type (for example, "UNFIT"). With such a configuration, it is possible to set a greater value to the upper limit number of the first type, which is used in external apparatus 500 and frequently used in general (for example, about 2,000 banknotes can be stored in an ATM cassette). Meanwhile, it is possible to set a smaller value to the upper limit number of the second type, which is for uses other than the use in external apparatus 500 and is not frequently used in general. In addition, it also is possible to set a smaller value to the upper limit number of the third type, which is only returned to the center bank without being redistributed, for example.

In addition, by changing the upper limit number of the paper sheets to be stacked in the above-mentioned manner, the operator can recognize at a glance that the paper sheets stacked in the stacking unit of stacking units 60*a* to 60*h* are of the first type (for example, "ATM-FIT"), and thus task efficiency can be increased.

In addition, the upper limit number of sheets set for the second type (for example, "Teller-FIT") may be identical or substantially identical (for example, a difference of only 10% or smaller) to the upper limit number of sheets set for the third type (for example, "UNFIT"). In this manner, the number of the paper sheets to be stacked in stacking units 60*a* to 60*h* as the second type and the number of the paper sheets to be stacked in stacking units 60*a* to 60*h* as the third type can be set to values identical or substantially identical to each other, and thus the task of the operator for memorizing the number of paper sheets to be stacked can be reduced.

In a specific example case where the sort type includes the fitness of the banknote, the upper limit number can be set such that the upper limit number of banknotes to be stacked in stacking units 60*a* to 60*d* is set to 500 notes of 100 U.S. dollars of the first type (for example, "ATM-FIT"), the upper limit number of banknotes to be stacked in stacking units 60*e* to 60*g* is set to 100 notes of 100 U.S. dollars of the second type (for example, "Teller-FIT"), and the upper limit number of banknotes to be stacked in stacking unit 60*h* is set to 100 notes of 100 U.S. dollars of the third type (for example, "UNFIT").

It is to be noted that the upper limit number of sheets set for the second type is not required to be identical to the upper limit number of sheets set for the third type, and, for example, the upper limit number of sheets set for the second type may be larger than the upper limit number of sheets set for the third type, or smaller than the upper limit number of sheets set for the third type. Likewise, the upper limit number of sheets set for the first type is not required to be larger than the upper limit number of sheets set for the second type and/or the upper limit number of sheets set for the third type, and conversely, the upper limit number of sheets set for the first type may be smaller than the upper limit number of sheets set for the second type and/or the upper limit number of sheets set for the third type.

In addition, in the case where the sort type includes the face/back of a paper sheet, the upper limit number of sheets to be stacked can be set for each of a paper sheet whose top surface is the front surface at the time of stacking in stacking units 60*a* to 60*h*, and a paper sheet whose top surface is the rear surface at the time of stacking in stacking units 60*a* to 60*h*. In this case, the details of the sort type are the front surface and the rear surface. For example, the upper limit number can be set such that the upper limit number of banknotes to be stacked in stacking unit 60*a* is set to 200 notes of 1,000 yen whose top surface is the front surface, and that the upper limit number of banknotes to be stacked in stacking unit 60*b* is 100 notes of 1,000 yen whose top surface is the rear surface. Alternatively, the upper limit number of banknotes to be stacked in stacking unit 60*h* can be set to 500 notes of mixed currency and denomination whose top surface is the rear surface (or front surface).

In addition, in the case where the sort type includes the orientation of a paper sheet, the upper limit number of sheets to be stacked can be set for each of paper sheets whose orientation is face-up and portrait-up, face-up and portrait-down, face-down and portrait-up, and, face-down and portrait-down at the time of stacking in stacking units 60*a* to 60*h*. In this case, the details of the sort type are face-up and portrait-up, face-up and portrait-down, face-down and portrait-up and face-down and portrait-down. For example, the upper limit can be set such that the upper limit number of banknotes to be stacked in stacking unit 60*a* is set to 200 notes of 1,000 yen whose orientation is face-up and portrait-up, that the upper limit number of banknotes to be stacked in stacking unit 60*b* is set to 200 notes of 1,000 yen whose orientation is face-up and portrait-down, that the upper limit number of banknotes to be stacked in stacking unit 60*c* is set to 100 notes of 1,000 yen whose orientation is face-down and portrait-up, and that the upper limit number of banknotes to be stacked in stacking unit 60*d* is set to 100 notes of 1,000 yen whose orientation is face-down and portrait-down. Alternatively, the upper limit can be set such that the upper limit number of banknotes to be stacked in stacking unit 60*e* 200 notes of mixed currency and denomination whose orientation is face-up and portrait-up, that the upper limit number of banknotes to be stacked in stacking unit 60*f* is set to 200 notes of mixed currency and denomination whose orientation is face-up and portrait-down, that the upper limit number of banknotes to be stacked in stacking unit 60*g* is set to 100 notes of mixed currency and denomination whose orientation is face-down and portrait-up, and that the upper limit number of banknotes to be stacked in stacking unit 60*h* is set to 100 notes of mixed currency and denomination whose orientation is face-down and portrait-down.

In the case where paper sheet processing machine 100 of the present embodiment can be switched to a changing mode for changing the upper limit number of the paper sheets linked with the detail of the sort type of paper sheets stored in storage units 56, 136 and 560, the upper limit number of the paper sheets to be stacked in stacking units 60*a* to 60*h* can be for the detail of at least one of the sort types, namely, the currency type, denomination of a banknote, printing type of a banknote, fitness of a paper sheet, face/back of a paper sheet and orientation of a paper sheet on the basis of the detail. Accordingly, the upper limit number of sheets to be stacked in stacking units 60*a* to 60*h* can be specifically set on the basis of the detail of the sort type as necessary.

Second Embodiment

Next, the second embodiment of the present invention is described. While an exemplary case where 16 stacking units, 60*a* to 60*p*, are provided is described in the second embodiment as illustrated in FIG. 11, this is a merely an example, and the number of stacking units 60*a* to 60*p* may be smaller than 16 or larger than 16.

Figure 10:
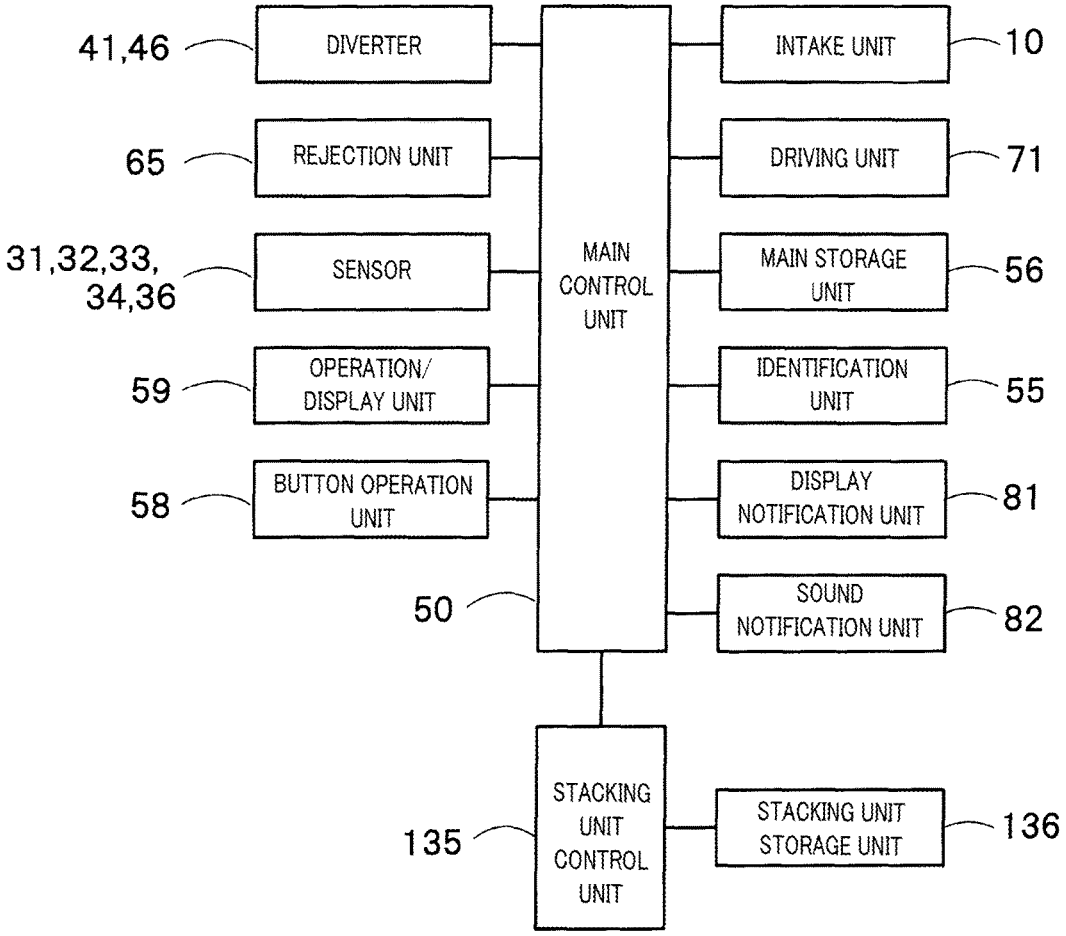
FIG. 10 is a control block diagram of a paper sheet processing machine of a second embodiment of the present invention.
Figure 11:
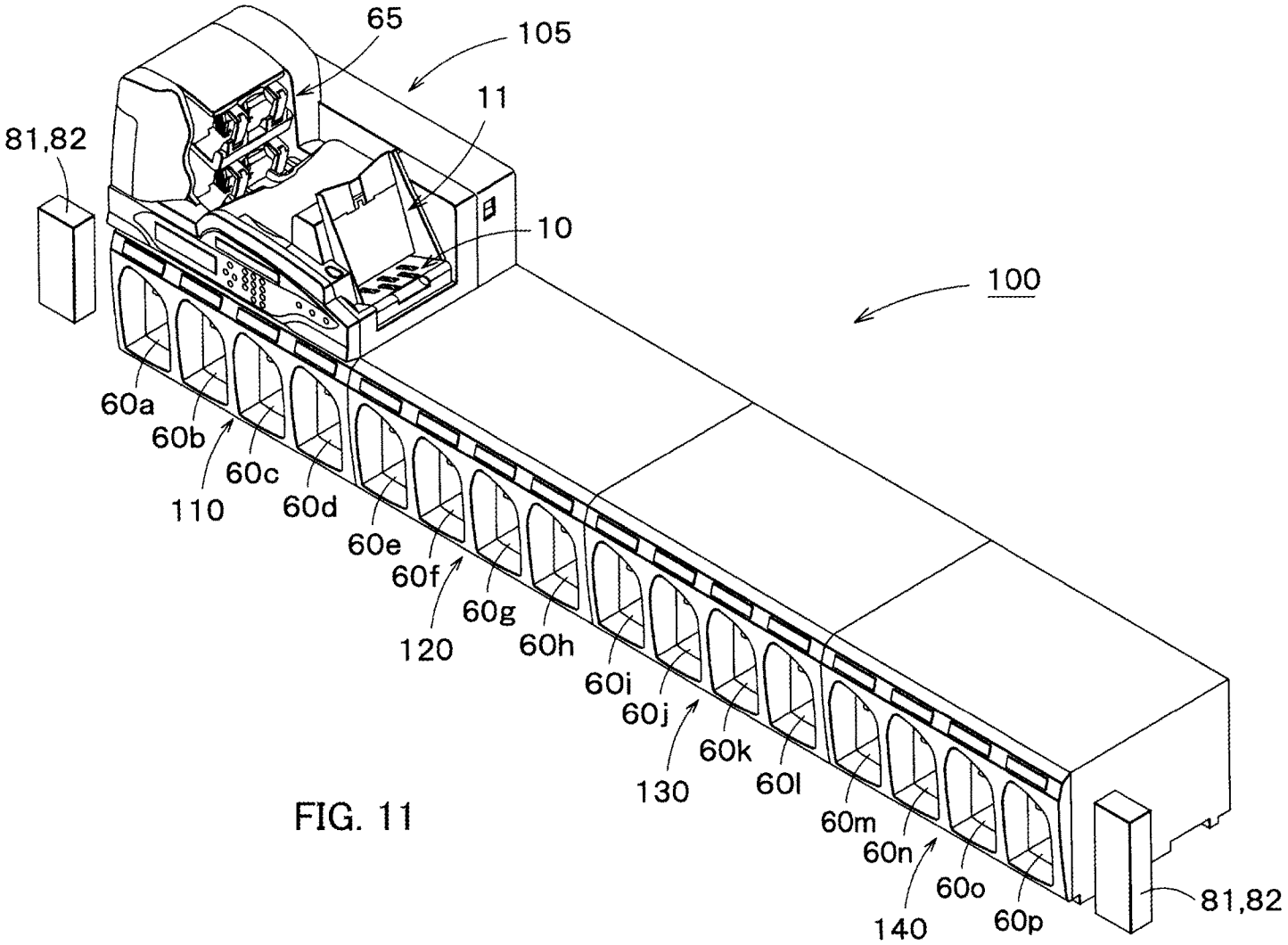
FIG. 11 is a perspective view illustrating an external appearance of the paper sheet processing machine of the second embodiment of the present invention.

In the present embodiment, paper sheet processing machine 100 includes three or more stacking units, namely, stacker units 110, 120, 130 and 140, and notification units 81 and 82 corresponding to stacker units 110, 120, 130 and 140 are provided (see FIG. 10 and FIG. 11). To be more specific, when an error is caused and/or a predetermined number of paper sheets are stacked in some of stacking units 60*a* to 60*p*, notification units 81 and 82 of the present embodiment indicate the general location of the stacking units 60*a* to 60*p* and/or the general location of the error. To be more specific, in the present embodiment, as viewed from the front face side of paper sheet processing machine 100, notification units 81 and 82 may be provided on the left side (or around a left end portion) and/or the right side (or around a right end portion) (see FIG. 11). In addition, notification units 81 and 82 may be provided at locations corresponding to stacker units 110, 120, 130 and 140. In addition, it is also possible to employ a configuration in which only a pair of notification units 81 and 82 is provided, and the location of stacking units 60*a* to 60*p* in which a predetermined number of paper sheets are stacked and/or the location of stacking units 60*a* to 60*p* in which an error is caused is roughly indicated by a difference in information indicated by the notification units 81 and 82 such as a difference in output sound information (difference in sound and/or sound) and a difference in displayed information (a difference in displayed color, letters, mark and/or display style).

It is to be noted that, it is possible to employ as notification units 81 and 82 display notification unit 81 which can be visually recognized by the operator such as PATLITE (registered trademark) and an LED, or sound notification unit 82 which can be recognized by the operator with the sense of hearing such as a buzzer, or, both of display notification unit 81 and sound notification unit 82 (see FIG. 10).

Other configurations of the second embodiment are substantially similar to those of the first embodiment. The configurations of the second embodiment identical to those of the first embodiment are denoted with the same reference numerals, and the description thereof is omitted.

Also with the present embodiment, effects similar to those of the first embodiment can be achieved.

In addition, according to the present embodiment, when an error is caused and/or a predetermined number of paper sheets are stacked in some of stacking units 60*a* to 60*p*, the location of the concerned stacking unit of stacking units 60*a* to 60*p* and/or the general location of the error can be indicated by notification units 81 and 82. Thus, the operator can easily recognize the location of the stacking unit of stacking units 60*a* to 60*p* in which a predetermined number of paper sheets are stacked and/or the location of units 105, 110, 120, 130 and 140 in which an error is caused. As a result, the operator can easily recognize the part which requires a task of the operator, and thus task efficiency can be increased.

In addition, in the case where notification units 81 and 82 are provided on the left side (or around a left end portion) and the right side (or around a right end portion) as viewed from the front face side of paper sheet processing machine 100 (see FIG. 11), it is possible to notify the operator of the general location of units 105, 110, 120, 130 and 140 which require a task of the operator by notification units 81 and 82 while reducing the number of notification units 81 and 82 to be installed.

Likewise, in the case where notification units 81 and 82 are provided at a position corresponding to any of stacker units 110 and 120 located on the left side, and any of stacker units 130 and 140 located on the right side as viewed from the front face side of paper sheet processing machine 100, it is possible to notify the operator of the general location of units 105, 110, 120, 130 and 140 which require a task of the operator by notification units 81 and 82 while reducing the number of notification units 81 and 82 to be installed.

In addition, in the case where notification units 81 and 82 are provided to correspond to stacker units 110, 120, 130 and 140, units 105, 110, 120, 130 and 140 which require a task of the operator can be exactly specified, and thus task efficiency can be further increased.

It is to be noted that, in the present embodiment, when an error is caused in upper unit 105, predetermined information is indicated by notification units 81 and 82 which provide a notification when an error is caused and/or a predetermined number of paper sheets are stacked in stacker unit 110 located on the left end as viewed from the front face side of paper sheet processing machine 100.

Note that, the notification styles of notification units 81 and 82 may be different from each other between the case where an error is caused and the case where a predetermined number of paper sheets are stacked in some of stacking units 60*a* to 60*p*. With such a configuration, it is possible to easily determine whether the required task of the operator is simply removing a paper sheet in stacking units 60*a* to 60*p*, or cancelling the error caused in units 105, 110, 120, 130 and 140.

In the case where display notification unit 81 which can be visually recognized by the operator is employed as notification units 81 and 82, it suffices to change the display style of display notification unit 81 between the case where error is caused and the case where a predetermined number of paper sheets are stacked an in some of stacking units 60*a* to 60*p*. In an example case where a PATLITE is used, it suffices to change the display style of the PATLITE between the case where error is caused and the case where a predetermined number of paper sheets are stacked an in some of stacking units 60*a* to 60*p*. In another example case where an LED is used, it suffices to display letter information of "BATCH" when a predetermined number of paper sheets are stacked in some of stacking units 60*a* to 60*p*, for example, and to display letter information of "ERROR" when an error is caused, for example. In this case, it is possible to indicate that a predetermined number of paper sheets are stacked in stacking units 60*a* to 60*p* while specifying stacking units 60*a* to 60*p* in which a predetermined number of paper sheets are stacked, or it also is possible to indicate that an error is caused while specifying units 105, 110, 120, 130 and 140 in which an error is caused.

In addition, in the case where sound notification unit 82 which can be recognized by the operator with the sense of hearing is employed as notification units 81 and 82, it suffices to change sound information of sound notification unit 82 between the case where error is caused and the case where a predetermined number of paper sheets are stacked in some of stacking units 60*a* to 60*p*. For example, it is possible to indicate with sound that a predetermined number of paper sheets are stacked in stacking units 60*a* to 60*p*, or it also is possible to indicate with sound that an error is caused. It is to be noted that, in this case, it is possible to indicate with sound that a predetermined number of paper sheets are stacked in stacking units 60*a* to 60*p* while specifying stacking units 60*a* to 60*p* in which a predetermined number of paper sheets are stacked, or it is also possible to indicate with sound that an error is caused while specifying units 105, 110, 120, 130 and 140 in which an error is caused.

Note that, the notification styles of notification units 81 and 82 may be different from each other in accordance the type of the error. With such a configuration, the operator can easily determine the type of the error.

In addition, in the case where sound notification unit 82 simply outputs a sound such as a buzzer, the sound generated by sound notification unit 82 located on the left side and the sound generated by sound notification unit 82 located on the right side, as viewed from the front face side of paper sheet processing machine 100, may be different from each other. In this case, the operator can determine the general location where the task of the operator is required also with the difference in sound.

Note that, individual display units 51*a* to 51*h* may display a fact that a predetermined number of paper sheets are stacked in some of stacking units 60*a* to 60*p*. With such a display of individual display units 51*a* to 51*h*, the stacking unit in stacking units 60*a* to 60*p* where a predetermined number of paper sheets are stacked can be exactly specified.

In addition, when an error is caused, it is possible to change, from the normal state, the display style of one or more individual display units 51*a* to 51*h* provided to stacker units 110, 120, 130 and 140 in accordance with the location of the error. For example, one or more individual display units 51*a* to 51*h* provided to stacker units 110, 120, 130 and 140 where an error is caused indicate an error. With such a configuration, the general location of units 105, 110, 120, 130 and 140 in which an error is caused can be notified to the operator without additionally providing notification units 81 and 82.

In addition, also in the case where a predetermined number of paper sheets are stacked in some of stacking units 60*a* to 60*p*, it is possible to change, from the normal state, the display style of one or more individual display units 51*a* to 51*h* provided to stacker units 110, 120, 130 and 140 in accordance with the location of stacking units 60*a* to 60*p* for a certain period, for example. For example, one or more individual display units 51*a* to 51*h* provided to stacker units 110, 120, 130 and 140 including stacking units 60*a* to 60*p* in which a predetermined number of paper sheets are stacked indicate that a predetermined number of paper sheets stacked. With such a configuration, the general location of units 105, 110, 120, 130 and 140 in which predetermined number of paper sheets are stacked can be notified to the operator without additionally providing notification units 81 and 82. It is also possible to employ a configuration in which, after the display style of individual display units 51*a* to 51*h* corresponding to certain stacking units 60*a* to 60*p* in which a predetermined number of paper sheets are stacked is changed from the normal state for a certain period, individual display units 51*a* to 51*h* display that fact.

Incidentally, while the second embodiment is substantially identical to the first embodiment in the above descriptions, the present invention is not limited to this. That is, the configuration of the second embodiment may be independent of the configuration of the first embodiment. In view of this, the configuration is not limited as long as paper sheet processing machine 100 includes three or more stacking units, namely, stacker units 110, 120, 130 and 140, and a plurality of notification units 81 and 82 corresponding to stacker units 110, 120, 130 and 140 are provided.

Third Embodiment

Next, the third embodiment of the present invention is described.

In the third embodiment, the operation of each of driving units 105*a*, 110*a*, 120*a*, 130*a*, and 140*a* provided in certain units 105, 110, 120, 130 and 140, and driving units 105*a*, 110*a*, 120*a*, 130*a*, and 140*a* provided in units 105, 110, 120, 130 and 140 different from the certain units 105, 110, 120, 130 and 140 can be independently controlled. In a specific example of the paper sheet processing machine including eight stacking units 60*a* to 60*h* as illustrated in FIG. 1 and FIG. 2, the operation of each of upper driving unit 105*a* provided in upper unit 105, first lower driving unit 110*a* provided in first stacker unit 110 including stacking units 60*a* to 60*d*, and second lower driving unit 120*a* provided in second stacker unit 120 including stacking units 60*e* to 60*h* can be independently controlled.

It is possible that each of upper driving unit 105*a*, first lower driving unit 110*a* and second lower driving unit 120*a* is driven only when necessary for transporting of paper sheets. In addition, in the case where a certain time period is required for the activation of driving unit 71, it is possible to drive second lower driving unit 120*a* only when control units 50, 135 and 550 determine that driving is required based on an identification result of identification unit 55 while driving unit 71 located on the upstream side, namely, upper driving unit 105*a* and first lower driving unit 110*a* in the configuration illustrated in FIG. 1 and FIG. 2, is driven at all times during the processing of paper sheets.

Other configurations of the third embodiment are substantially similar to those of the first embodiment. The configurations of the third embodiment identical to those of the first embodiment are denoted with the same reference numerals, and the description thereof is omitted.

Also with the present embodiment, effects similar to those of the first embodiment can be achieved.

In addition, according to the present embodiment, the operation of each of upper driving unit 105*a*, first lower driving unit 110*a* and second lower driving unit 120*a* can be independently controlled. Accordingly, it is possible to drive only one or more of upper driving unit 105*a*, first lower driving unit 110*a* and second lower driving unit 120*a* required to be driven as necessary for transporting of paper sheets. Accordingly, power consumption can be suppressed, and noise generated by wastefully driving the driving unit 71 can be suppressed.

In addition, even in the case where a certain period of time is required for the activation of driving unit 71, power saving and low noise can be achieved without reducing the processing efficiency of paper sheets with a configuration in which driving unit 71 located on the upstream side is driven at all times during the processing of paper sheets and driving unit 71 located on the downstream side is driven only when control units 50, 135 and 550 determine that driving is required based on an identification result of identification unit 55.

It is to be noted that the usefulness of the present embodiment increases as the number of stacking units 60 increases. An example case is described below where 16 stacking units, 60*a* to 60*p*, are provided as illustrated in FIG. 4. Here, the operation of each of upper driving unit 105*a*, first lower driving unit 110*a*, second lower driving unit 120*a*, third lower driving unit 130*a* and fourth lower driving unit 140*a* can be independently controlled (see FIG. 6).

In the configuration illustrated in FIG. 4, the frequency of stacking of paper sheets in stacking units 60*i* to 60*l* and/or stacking units 60*m* to 60*p* tends to be reduced in the "automatic determination mode" and the "dynamic determination mode." Accordingly, power consumption can be further suppressed, and noise generated by wastefully driving the driving unit 71 can be suppressed by driving third lower driving unit 130*a* and fourth lower driving unit 140*a* only when necessary for transporting of paper sheets.

In addition, in the case where a certain time period is required for the activation of driving unit 71 in the configuration illustrated in FIG. 4, driving unit 71 located on the upstream side, namely, upper driving unit 105*a*, first lower driving unit 110*a* and second lower driving unit 120*a*, for example, is driven at all times during the processing of paper sheets, whereas driving unit 71 located on the downstream side, namely, third lower driving unit 130*a* and fourth lower driving unit 140*a* (or only fourth lower driving unit 140*a*), for example, is driven only when control units 50, 135 and 550 determine that driving is required based on an identification result of identification unit 55. Consequently, power saving and low noise can be achieved without reducing the processing efficiency of paper sheets. It is to be noted that, in this configuration, a certain periods of time is required until a paper sheet is transported to third stacker unit 130 (the second unit from the last in the transporting direction of paper sheets) after the paper sheet is identified by identification unit 55, and as a result, it is possible to reduce the possibility of a situation where the efficiency of the processing is reduced by failing to drive third lower driving unit 130*a* at the time point when the paper sheet reaches third stacker unit 130.

Incidentally, while the third embodiment is substantially identical to the first embodiment in the above descriptions, the present invention is not limited to this. That is, the configuration of the third embodiment may be independent of the configuration of the first embodiment. In view of this, the configuration is not limited as long as the operation of each of driving units 105*a*, 110*a*, 120*a*, 130*a*, and 140*a* provided in certain units 105, 110, 120, 130 and 140, and driving units 105*a*, 110*a*, 120*a*, 130*a*, and 140*a* provided in units 105, 110, 120, 130 and 140 different from the certain units 105, 110, 120, 130 and 140 can be independently controlled.

In addition, the third embodiment may be combined with the second embodiment. That is, in the third embodiment, paper sheet processing machine 100 may include three or more stacking units, namely, stacker units 110, 120, 130 and 140, and a plurality of notification units 81 and 82 corresponding to stacker units 110, 120, 130 and 140 may be provided (see FIG. 10 and FIG. 11).

Fourth Embodiment

Next, the fourth embodiment of the present invention is described.

Also in the fourth embodiment, the operation of each of driving units 105*a*, 110*a*, 120*a*, 130*a*, and 140*a* provided in certain units 105, 110, 120, 130 and 140, and driving units 105*a*, 110*a*, 120*a*, 130*a*, and 140*a* provided in units 105, 110, 120, 130 and 140 different from the certain units 105, 110, 120, 130 and 140 can be independently controlled as with the third embodiment. In a specific example of a paper sheet processing machine including 16 stacking units, 60*a* to 60*p*, illustrated in FIG. 4, it is possible to independently control the operation of each of upper driving unit 105*a* provided in upper unit 105, first lower driving unit 110*a* provided in first stacker unit 110 including stacking units 60*a* to 60*d*, second lower driving unit 120*a* provided in second stacker unit 120 including stacking units 60*e* to 60*h*, third lower driving unit 130*a* provided in third stacker unit 130 including stacking units 60*i* to 60*l*, and fourth lower driving unit 140*a* provided in fourth stacker unit 140 including stacking units 60*m* to 60*p*.

In the present embodiment, in the case where an error such as abnormal transport is caused, driving of driving unit 71 in units 105, 110, 120, 130 and 140 in which an error is caused is stopped, and a paper sheet being transported is appropriately transported to stacking units 60*a* to 60*p*, namely, to the closest stacking unit of stacking units 60*a* to 60*p* located on the downstream side of the paper sheet without stopping the driving of driving unit 71 in units 105, 110, 120, 130 and 140 other than the units 105, 110, 120, 130 and 140 in which an error is caused. It is to be noted that the above-mentioned configuration is merely an example, and it suffices that a paper sheet being transported can be transported to stacking units 60*a* to 60*p* on the downstream side relative to the paper sheet, in units 105, 110, 120, 130 and 140 other than the units 105, 110, 120, 130 and 140 in which an error is caused.

Other configurations of the fourth embodiment are substantially similar to those of the first embodiment. The configurations of the fourth embodiment identical to those of the first embodiment are denoted with the same reference numerals, and the description thereof is omitted.

Also with the present embodiment, effects similar to those of the first embodiment can be achieved.

In addition, according to the present embodiment, the driving of driving unit 71 in all units 105, 110, 120, 130 and 140 is not stopped even in the case where an error such as abnormal transport is caused, and driving of driving unit 71 is stopped only in units 105, 110, 120, 130 and 140 in which an error is caused. Then, a paper sheet being transported is appropriately transported to stacking units 60*a* to 60*p*, namely, to the closest stacking unit of stacking units 60*a* to 60*p* located on the downstream side of the paper sheet without stopping the driving of driving unit 71 in units 105, 110, 120, 130 and 140 other than the units 105, 110, 120, 130 and 140 in which an error is caused. In this manner, the paper sheet being transported in units 105, 110, 120, 130 and 140 in which no error is caused can be transported to the corresponding stacking unit of stacking units 60*a* to 60*p*, and it is unnecessary to take the trouble to open casing 1 to remove the paper sheet. In addition, the possibility of leaving of paper sheets in casing 1 can be reduced.

The above-mentioned points are described below. In the case where an error such as abnormal transport is caused, when the driving of driving unit 71 is stopped in units 105, 110, 120, 130 and 140 in which no error is caused, the paper sheets in the units 105, 110, 120, 130 and 140 are also required to be collected by opening casing 1. In view of this, according to the present embodiment, it is unnecessary to collect the paper sheets in the units 105, 110, 120, 130 and 140 by opening casing 1 for units 105, 110, 120, 130 and 140 in which no error is caused as described above.

In this manner, according to the present embodiment, the task efficiency of the operator can be increased, and leaving of paper sheets in the transport path can be prevented as much as possible.

In addition, according to the present embodiment, paper sheets are transported to stacking units 60*a* to 60*p* of stacker units 110, 120, 130 and 140 in which no error is caused, and thus occurrence of error in a stacking unit of stacker units 110, 120, 130 and 140 including stacking units 60*a* to 60*p* to which no paper sheet is transported can be recognized by the operator. Incidentally, in the case where an error is caused in upper unit 105, but no error is caused in stacker units 110, 120, 130 and 140, paper sheets can be transported to stacking units 60*a* to 60*p* of stacker units 110, 120, 130 and 140. Accordingly, when a paper sheet is transported to stacking units 60*a* to 60*p* of stacker units 110, 120, 130 and 140, the operator can recognize occurrence of an error such as abnormal transport in upper unit 105.

Next, description will be made with a specific example. In this specific example, it is assumed that an error of paper sheet jam is caused in third stacker unit 130 in FIG. 4. In this case, while the driving of third lower driving unit 130*a* is stopped, driving of other driving unit 71, namely, upper driving unit 105*a*, first lower driving unit 110*a*, second lower driving unit 120*a* and fourth lower driving unit 140*a* is not stopped, and paper sheets which exist in upper unit 105, first stacker unit 110, second stacker unit 120 and fourth stacker unit 140 in the case of error are transported toward a closest stacking unit of stacking units 60*a* to 60*p* located on the downstream side of the paper sheet. With this configuration, the operator needs only to remove the paper sheet in third stacker unit 140 by opening only third stacker unit 140 without opening upper unit 105, first stacker unit 110, second stacker unit 120 and fourth stacker unit 140.

Incidentally, while the fourth embodiment is substantially identical to the first embodiment in the above descriptions, the present invention is not limited to this. That is, the configuration of the fourth embodiment may be independent of the configuration of the first embodiment. In view of this, the configuration is not limited as long as, in the case where an error such as abnormal transport is caused, driving of driving unit 71 in units 105, 110, 120, 130 and 140 in which an error is caused is stopped, and the driving of driving unit 71 in units 105, 110, 120, 130 and 140 other than the units 105, 110, 120, 130 and 140 in which an error is caused is not stopped, and, a paper sheet being transported is appropriately transported to stacking units 60*a* to 60*p*.

In addition, fourth embodiment may be combined with the second embodiment. That is, in the fourth embodiment, paper sheet processing machine 100 may include three or more stacking units, namely, stacker units 110, 120, 130 and 140, and notification units 81 and 82 corresponding to a plurality of stacker units, 110, 120, 130 and 140, may be provided (see FIG. 10 and FIG. 11).

It should be understood by those skilled in the art that various modifications, combinations, sub-combinations and alterations may occur depending on design requirements and other factors in so far as they are within the scope of the appended claims or the equivalents thereof.

In the following, with reference to the accompanying drawings embodiments of the present invention are described.

Embodiment (Configuration)

A valuable medium handling machine according to the embodiment of the present invention is described below with reference to the accompanying drawings. Here, FIG. 12 to FIG. 19 are drawings for describing the embodiment of the present invention. In addition, examples of the valuable medium processed by valuable medium handling machine 1100 of the present embodiment include a banknote, a coin, a check, a gift certificate, a bar code ticket, a chip, and the like. While valuable medium handling machine 1100 processes a paper sheet (such as a banknote) in the following descriptions, this configuration is merely an example, and the present invention is not limited to this. In view of this, the term "paper sheet" stated below can be replaced with "valuable medium."

Note that, in the present embodiment, the term "valuable medium processing system" includes "valuable medium handling machine 1100." In view of this, the "valuable medium processing system" recited in "claims" can be valuable medium handling machine 1100, or a combination of valuable medium handling machine 1100 and other apparatuses. In the following descriptions, mainly, the valuable medium processing system is a combination of valuable medium handling machine 1100 and other apparatuses.

Figure 13:
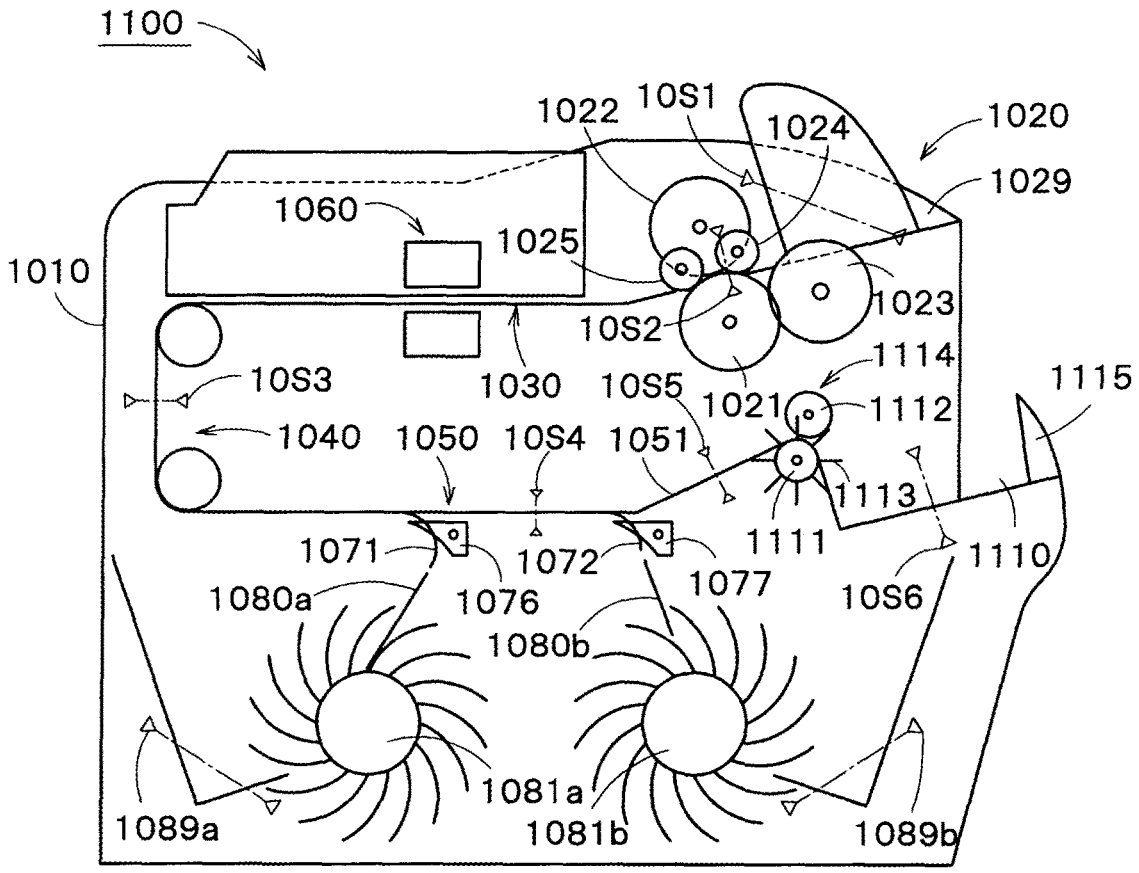
FIG. 13 schematically illustrates an internal configuration of the valuable medium handling machine of the embodiment of the present invention as viewed from the front side.

As illustrated in FIG. 13, valuable medium handling machine 1100 of the present embodiment includes casing 1010, intake unit 1020 configured to take a paper sheet one by one into casing 1010, first transport unit 1030 configured to transport a paper sheet taken by intake unit 1020 along a substantially horizontal direction (left direction in FIG. 13), and identification unit 1060 configured to identify a paper sheet transported by first transport unit 1030. Intake unit 1020 includes placing unit 1029 on which a plurality of paper sheets are placed and stacked, and intake unit 1020 takes paper sheets placed on placing unit 1029 one by one into casing 1010. In the present embodiment, paper sheets are transported along the short-edge direction, and paper sheets are placed at placing unit 1029 such that the short-edge direction extends in the horizontal direction of FIG. 13 and that the long-edge direction extends in the depth direction of FIG. 13.

Identification unit 1060 may include a fluorescent sensor configured to acquire information relating to a paper sheet by use of fluorescence, an infrared sensor configured to acquire information relating to a paper sheet by use of infrared light, a thickness detection sensor configured to detect the thickness of a paper sheet, a magnetic sensor configured to acquire information relating to a banknote by use of magnetism, a red light sensor configured to acquire information relating to a banknote by use of red light, a line sensor configured to detect the transmission light and the reflection light of the both paper surfaces with infrared light and green light, and the like, for example.

In addition, valuable medium handling machine 1100 also includes second transport unit 1050 located on the lower side of first transport unit 1030, intermediate transport unit 1040 located between first transport unit 1030 and second transport unit 1050, and a plurality of (two, in the present embodiment) stacking units 1080*a* and 1080*b* located on the lower side of second transport unit 1050. Second transport unit 1050 transports the paper sheet identified by identification unit 1060 along a second direction (the right direction in FIG. 13) opposite to the first direction. Intermediate transport unit 1040 couples first transport unit 1030 and second transport unit 1050. Stacking units 1080*a* and 1080*b* stack the paper sheet transported by second transport unit 1050 and include openings 80*h* and 90*h* that open on the front side (see FIG. 12). Stacking units 1080*a* and 1080*b* are provided with stacking wheels 1081*a* and 1081*b*, respectively, for stacking paper sheets transported by second transport unit 1050 in stacking units 1080*a* and 1080*b*.

Figure 14:
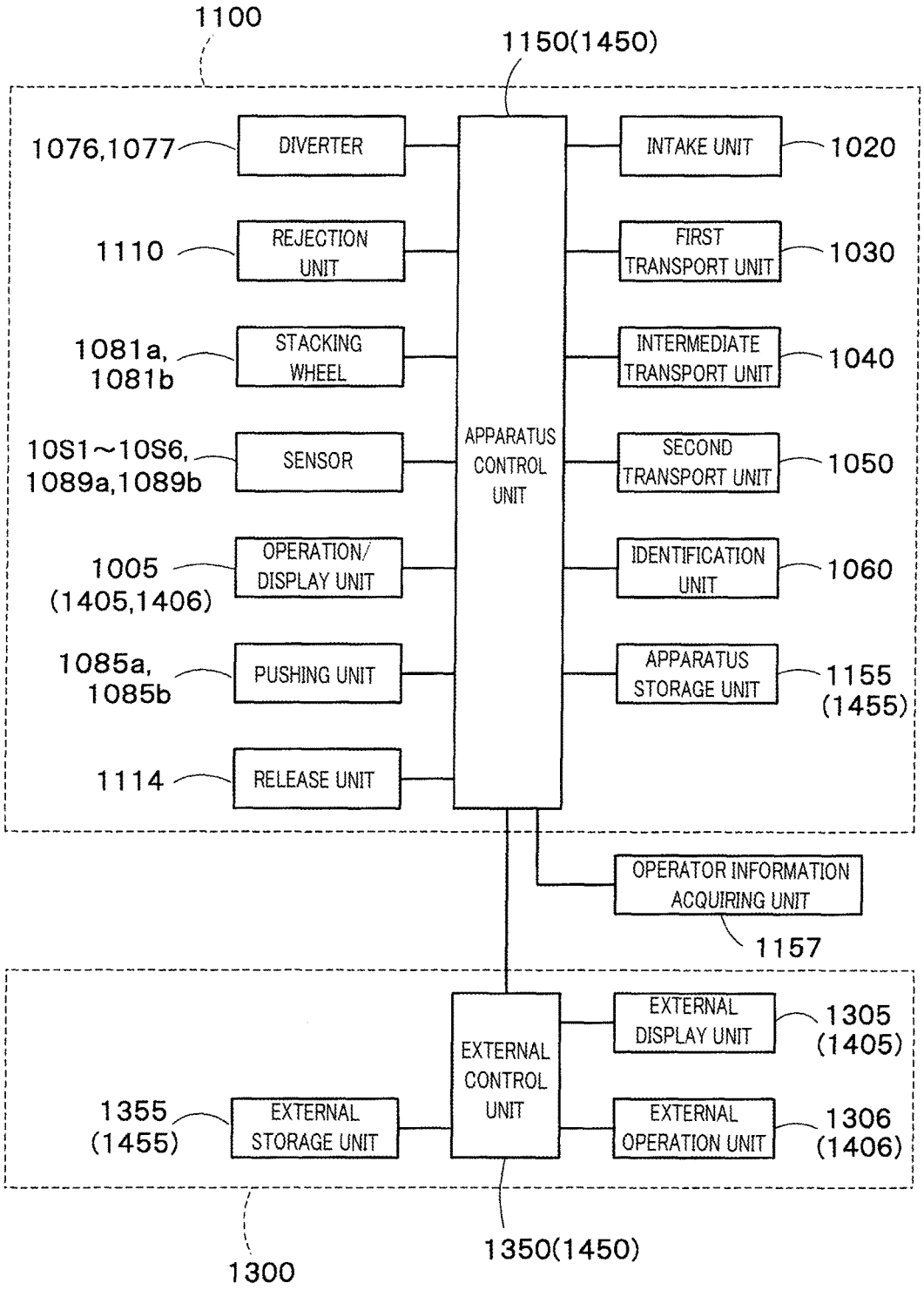
FIG. 14 is a control block diagram for describing connection in the valuable medium processing system of the embodiment of the present invention.

In addition, stacking units 1080*a* and 1080*b* are provided with pushing units 1085*a* and 1085*b* for pushing paper sheets stacked in stacking units 1080*a* and 1080*b* toward the front side (see FIG. 14). After a predetermined number of paper sheets are stacked in stacking units 1080*a* and 1080*b*, pushing units 1085*a* and 1085*b* push the paper sheets stacked in stacking units 1080*a* and 1080*b* to the outside of casing 1010 from openings 80*h* and 90*h* on the front side of the stacking units 1080*a* and 1080*b*. In this manner, according to the present embodiment, the operator can surely stack the paper sheets by a predetermined number in stacking units 1080*a* and 1080*b*, and thereafter, the operator can easily take out the paper sheet from stacking units 1080*a* and 1080*b*. It is to be noted that pushing units 1085*a* and 1085*b* may push the paper sheets stacked in stacking units 1080*a* and 1080*b* to the outside of casing 1010 from openings 80*h* and 90*h* on the front side of stacking units 1080*a* and 1080*b* after all of the paper sheets placed at placing unit 1029 are distributed to stacking units 1080*a* and 1080*b* and/or rejection unit 110 described later.

As illustrated in FIG. 13, in the present embodiment, first transport unit 1030, intermediate transport unit 1040 and second transport unit 1050 form a substantially U-shape. The paper sheet taken in casing 1010 by intake unit 1020 is transported one by one through first transport unit 1030, intermediate transport unit 1040, and second transport unit 1050 in this order. Each of first transport unit 1030, intermediate transport unit 1040 and second transport unit 1050 is composed of a combination of transport mechanisms. The transport mechanisms may include a pair of, or three or more transport rollers, and a transport belt such as a rubber belt installed around the transport rollers in a stretched state, for example. It is to be noted that the transport mechanisms may include a plurality of transport rollers that make contact with paper sheets, and a driving belt such as a rubber belt that drives the transport rollers.

As illustrated in FIG. 13, intake unit 1020 includes feed roller 1021 configured to perform feeding of paper sheets into casing 1010, reverse roller 22 provided at a position opposite to feed roller 1021 such that a gate unit is formed between feed roller 1021 and reverse roller 22, kicker roller 1023 configured to kick the paper sheet housed in placing unit 1029 to feed roller 1021, auxiliary roller 1024 for surely taking the paper sheet kicked out by kicker roller 1023 into the gate unit, and pinch roller 1025 having a friction coefficient higher than that of feed roller 1021 and configured for surely taking into first transport unit 1030 the paper sheet having passed between feed roller 1021 and reverse roller 22.

Identification unit 1060 identifies the fitness, the authentication, the denomination, the orientation, the face/back and the like of a paper sheet including a banknote transported in first transport unit 1030. Identification unit 1060 identifies the transport state including skew of the paper sheets, overlapping of the paper sheets, chain feeding of the adjacent paper sheets, and the like. The result of the identification of identification unit 1060 is sent to apparatus control unit 1150 described later (see FIG. 14).

Figure 12:
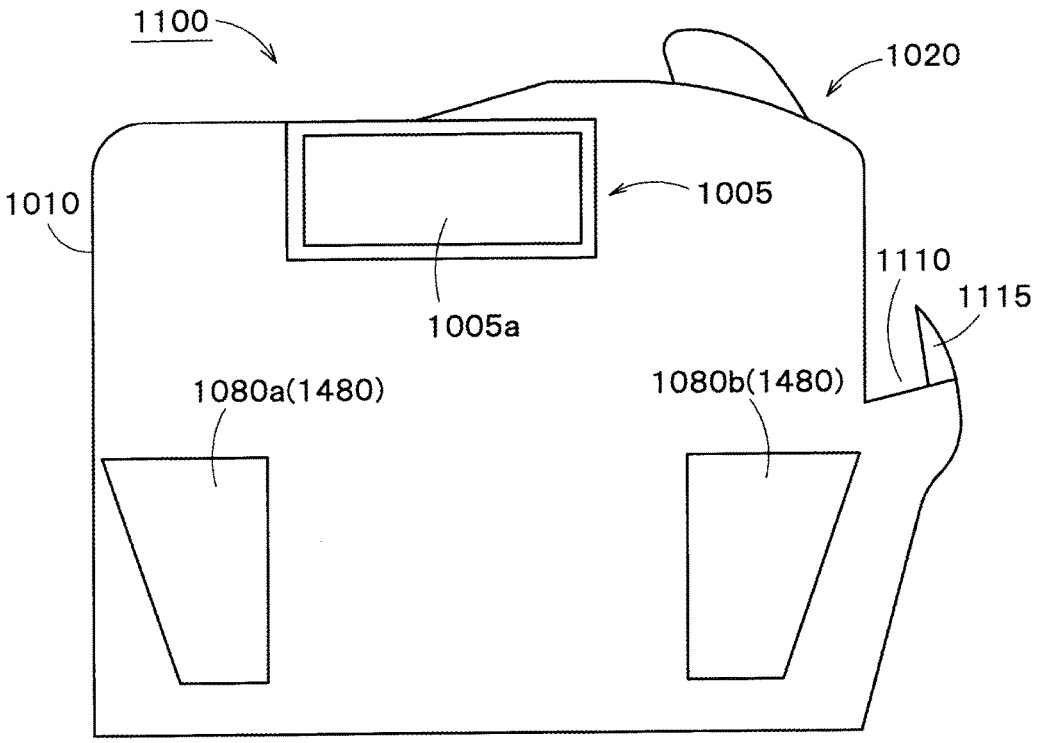
FIG. 12 is a front view of a valuable medium handling machine (paper sheet processing machine) of the embodiment of the present invention.

As illustrated in FIG. 12 and FIG. 13, in the present embodiment, two stacking units, stacking units 1080*a* and 1080*b*, are disposed in parallel with each other in the horizontal direction as viewed from the front side. Stacking units 1080*a* and 1080*b* stack and house in an upright state (at an angle of 45 degrees or greater to the horizontal direction) the paper sheet which satisfies the predetermined condition of identification unit 1060 among the paper sheets taken into casing 1010.

In the present embodiment, the side on which stacking units 1080*a* and 1080*b* open is defined as "front side." It is to be noted that openings of stacking units 1080*a* and 1080*b* may be provided on the side face side of casing 1010, and also with such a configuration, the paper sheets stacked in stacking units 1080*a* and 1080*b* are taken out mainly in the direction of the front side. It is to be noted that, in the present embodiment, transport of a paper sheet "along the horizontal direction" means a configuration of transporting a paper sheet in a direction including a "horizontal direction," and includes a configuration of transporting a paper sheet in a horizontal direction in a zigzag manner in a vertical direction, for example.

As illustrated in FIG. 13, diversion transport units 1071 and 1072 configured to couple second transport unit 1050 and stacking units 1080*a* and 1080*b* are provided between second transport unit 1050 and stacking units 1080*a* and 1080*b*.

In addition, diversion units 1076 and 1077 corresponding to stacking units 1080*a* and 1080*b*, and having a claw shape for diverting paper sheets transported by second transport unit 1050 to transport units 1071 and 1072 are provided, for example.

In the configuration illustrated in FIG. 12 and FIG. 13, stacking wheels 1081*a* and 1081*b* corresponding to stacking units 1080*a* and 1080*b* are provided between two stacking units, stacking units 1080*a* and 1080*b*, in the horizontal direction, and the rotational direction of stacking wheel 1081*a* located on the left side as viewed from the front side and the rotational direction of stacking wheel 1081*b* located on the right side as viewed from the front side are opposite to each other. To be more specific, on the lower right side of stacking unit 1080*a* located on the left side as viewed from the front side, stacking wheel 1081*a* configured to rotate counterclockwise as viewed from the front side is provided. In addition, on the lower left side of stacking unit 1080*b* located on the right side as viewed from the front side, stacking wheel 1081*b* configured to rotate clockwise as viewed from the front side is provided. It is to be noted that the stacking wheels 1081*a* and 1081*b* receive, in a space between the vane portions adjacent to each other, the paper sheets output into stacking units 1080*a* and 1080*b* from diversion transport units 1071 and 1072, and stack the paper sheets in stacking units 1080*a* and 1080*b* with the orientation and position of the paper sheets being regulated. As illustrated in FIG. 13, at the terminal end of second transport unit 1050, rejection unit 1110 for stacking paper sheets which are not stacked in stacking units 1080*a* and 1080*b* is provided. In the present embodiment, at least a part of rejection unit 1110 is provided above stacking unit 1080*b* located on the most downstream side in the transport direction of the paper sheet. Note that, the "housing unit" recited in claims includes both of rejection unit 1110 and stacking units 1080*a* and 1080*b*. It is to be noted that rejection unit 1110 and stacking units 1080*a* and 1080*b* are merely an example of the housing unit.

Release unit 1114 is provided at the terminal end of second transport unit 1050. Release unit 1114 includes release roller 1111 configured to send out the paper sheet from casing 1010 to rejection unit 1110, counter roller 1112 provided at a position opposite to release roller 1111, and rotatable elastic fin wheel 1113 provided coaxially with release roller 1111. The paper sheet sent to the terminal end of second transport unit 1050 is output to rejection unit 1110 from a space between release roller 1111 and counter roller 1112. The rear end edge of the paper sheet output in the above-mentioned manner is tapped by elastic fin wheel 1113, and the paper sheet is stacked in rejection unit 1110. In addition, stopper 1115 is provided at an end portion (right end portion in FIG. 13) of rejection unit 1110. Stopper 1115 is configured for preventing the paper sheet output from the position between release roller 1111 and counter roller 1112 from being displaced from rejection unit 1110 and being output to the outside. Stopper 1115 can be manually rotated clockwise, and the operator can freely take out the paper sheet housed in rejection unit 1110 by manually rotating stopper 1115 clockwise. In addition, second transport unit 1050 of the present embodiment includes tilted unit 1051 tilted upward toward rejection unit 1110 at a position on the downstream side in the transport direction of the paper sheet.

In the present embodiment, stacking units 1080*a* and 1080*b* stack paper sheets at an angle of 45 degrees or greater to the horizontal direction. In the configuration illustrated in FIG. 12 and FIG. 13, stacking unit 1080*a* on the left side as viewed from the front side stacks paper sheets at an angle of 45 degrees or greater to a given horizontal direction (left direction in FIG. 13, which is opposite to the paper sheet transport direction in second transport unit 1050), and stacking unit 1080*b* on the right side as viewed from the front side stacks paper sheets at an angle of 45 degrees or greater to the direction opposite to the given horizontal direction (right direction in FIG. 13, which is identical to the paper sheet transport direction in second transport unit 1050). While it is preferable that stacking units 1080*a* and 1080*b* stack paper sheets in a state where stacking units 1080*a* and 1080*b* are tilted at 45 degrees or greater to the horizontal direction, it is more preferable that stacking units 1080*a* and 1080*b* stack paper sheets in a state where stacking units 1080*a* and 1080*b* are tilted at 60 to 70 degrees to the horizontal direction so as to stack the paper sheets in the upright state.

In addition, in the configuration illustrated in FIG. 12 and FIG. 13, paper sheets are sequentially sent out, to stacking unit 1080*a* on the left side as viewed from the front side, in a direction including the direction opposite to the transport direction of the paper sheet by second transport unit 1050 (substantially left direction in FIG. 13), and paper sheets are sequentially sent out, to stacking unit 1080*b* on the right side as viewed from the front side, in a direction including the transport direction of the paper sheet by second transport unit 1050 (substantially right direction in FIG. 13).

Further, in the configuration of the present embodiment illustrated in FIG. 12 and FIG. 13, stacking wheel 1081*a* located on the left side as viewed from the front side rotates counterclockwise, and stacking wheel 1081*b* located on the right side as viewed from the front side rotates clockwise as described above. With this configuration, the upper part of stacking wheel 1081*a* is rotated in a direction including the direction opposite to the transport direction of the paper sheet by second transport unit 1050, and the upper part of stacking wheel 1081*b* is rotated in a direction including the transport direction of the paper sheet by second transport unit 1050.

As illustrated in FIG. 13, intake unit 1020 is provided with sensor 10S1 configured to detect whether a paper sheet is placed at placing unit 1029. In addition, sensor 10S2 is provided at an entrance portion of first transport unit 1030. Sensor 10S2 detects the fact that a paper sheet is surely taken into casing 1010.

Sensor 10S3 is provided at intermediate transport unit 1032, sensor 10S4 is provided on the downstream side of upstream side diversion unit 1076, and sensor 1055 is provided on the downstream side of diversion unit 1077 on the downstream side. To be more specific, sensor 10S3 is provided at intermediate transport unit 1032, and detects all paper sheets transported at second transport unit 1050. Sensor 10S4 is provided on the downstream side of upstream side diversion unit 1076, and detects only a paper sheet transported at second transport unit 1050 which is not separated by diversion unit 1076 to diversion transport unit 1071. In addition, sensor 10S5 is provided on the downstream side of diversion unit 1077 on the downstream side, and detects a paper sheet transported at second transport unit 1050 which is not separated by two diversion units 1076 and 1077 to diversion transport units 1071 and 1072. Stacking units 1080*a* and 1080*b* are provided with sensors 1089*a* and 1089*b*, respectively. Sensors 1089*a* and 1089*b* detect whether a paper sheet is housed in stacking units 1080*a* and 1080*b*. Likewise, rejection unit 1110 is provided with sensor 10S6, and sensor 10S6 detects whether paper sheets are housed in rejection unit 1110. While the term "paper sheet" is used as a valuable medium in the above descriptions since the above descriptions are based on valuable medium handling machine 1100 for processing the paper sheet illustrated in FIG. 12 and FIG. 13, the term "valuable medium" is used in the following descriptions as a general rule.

As illustrated in FIG. 12, valuable medium handling machine 1100 of the present embodiment also includes operation/display unit 1005 composed of a touch panel or the like disposed on the front side of casing 1010, for example. Operation/display unit 1005 receives the input from the operator, and displays the various kinds of information. While operation/display unit 1005 has a function of an operation unit for receiving operations including the input of the operator, and a function of a display unit for displaying various kinds of information in the present embodiment, the present invention is not limited to such a configuration, and the operation unit and the display unit may be separately provided. As an example configuration, operation/display unit 1005 includes display screen 1005*a* of about 7 inches. Operation/display unit 1005 of the present embodiment is included in "operation unit" of the claims.

As illustrated in FIG. 14, valuable medium handling machine 1100 of the present embodiment includes apparatus storage unit 155 storing history information of setting information for operating valuable medium handling machine 1100, and apparatus control unit 1150 configured to read history information of setting information from apparatus storage unit 1155 to operate valuable medium handling machine 1100. The history information may include setting information of at least one item. Here, apparatus storage unit 1155 is included in "storage unit" recited in claims, and apparatus control unit 1150 is included in "control unit" recited in claims. It is to be noted that the read history information of setting information is displayed on operation/display unit 1005. Here, operation/display unit 1005 is included in "output unit" recited in claims. In this case, operation/display unit 5 may read history information stored in apparatus storage unit 1155 and display the list thereof (see FIG. 16B, FIG. 16C, FIG. 17B and FIG. 17C). In this case, it is also possible that the specific detail of the history information is displayed on operation/display unit 1005 by selecting one piece of history information by pressing down the date and time and/or the operator ID number, not the check box, for example with operation/display unit 5.

Apparatus storage unit 1155 may store the operator who performed or used the setting and setting information in association with each other. In the case where multiple pieces of setting information can be associated with a particular operator, the history information of the multiple pieces of setting information may be stored (see FIG. 16C and FIG. 17C). In addition, apparatus storage unit 1155 may store history information by associating the date and time when the setting is performed or used, with setting information (see FIG. 16B, FIG. 16C, FIG. 17B and FIG. 17C).

In addition, history information may be retrieved. In the case where apparatus storage unit 1155 stores history information by associating the operator who performed or used the setting with setting information, the history information of setting information which is desired to be acquired can be extracted by performing retrieval by the operator, for example. In addition, in the case where apparatus storage unit 1155 stores history information by associating the date and time when the setting is performed or used with setting information, the history information of setting information which is desired to be acquired can be extracted by performing retrieval by the date and time, for example.

Figure 16A:
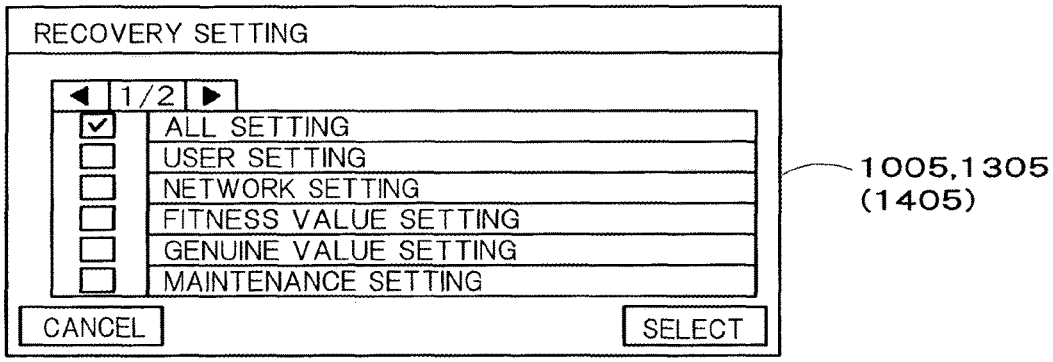
FIG. 16A illustrates an exemplary screen displayed on a display unit used in the valuable medium processing system of the embodiment of the present invention.
Figure 16B:
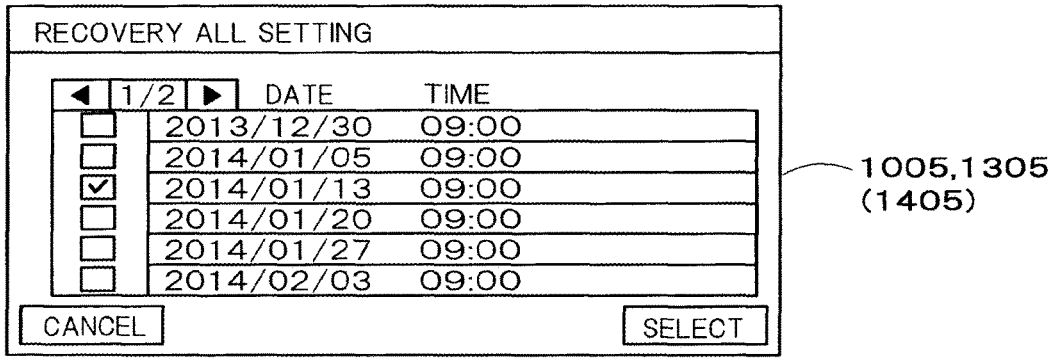
FIG. 16B illustrates an exemplary screen transferred from FIG. 16A.
Figure 17A:
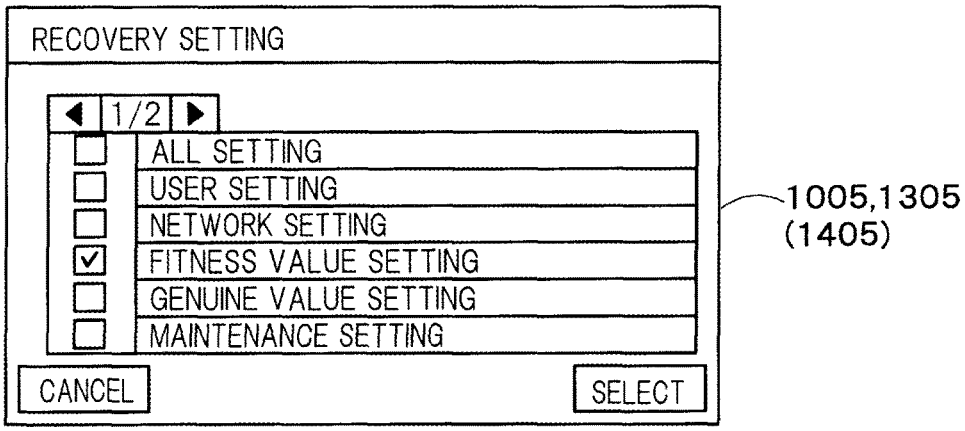
FIG. 17A illustrates an exemplary screen displayed on a display unit used in the valuable medium processing system of the embodiment of the present invention.
Figure 17B:
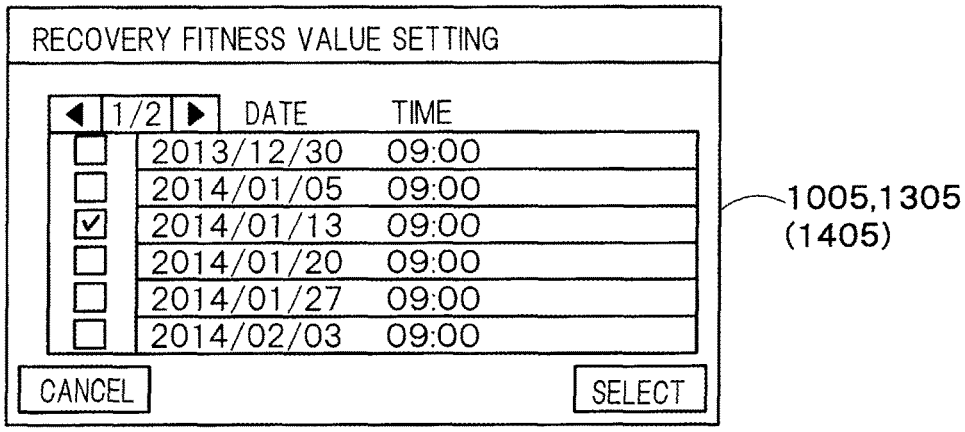
FIG. 17B illustrates an exemplary screen transferred from FIG. 17A.

It is to be noted that, in valuable medium handling machine 1100, it is possible to acquire setting information at a given interval, and store the information in apparatus storage unit 1155 as history information (see FIG. 16B and FIG. 17B). Note that, in the configuration illustrated in FIG. 16B and FIG. 17B, setting information is acquired every week and stored in apparatus storage unit 1155.

Figure 16C:
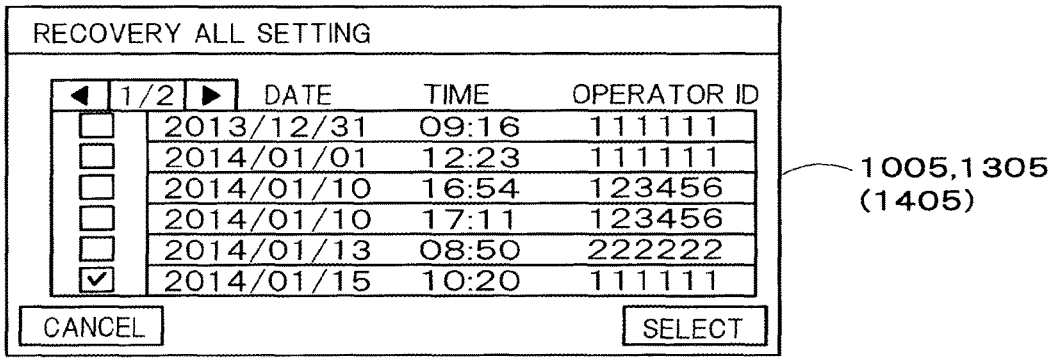
FIG. 16C illustrates another exemplary screen transferred from FIG. 16A.
Figure 17C:
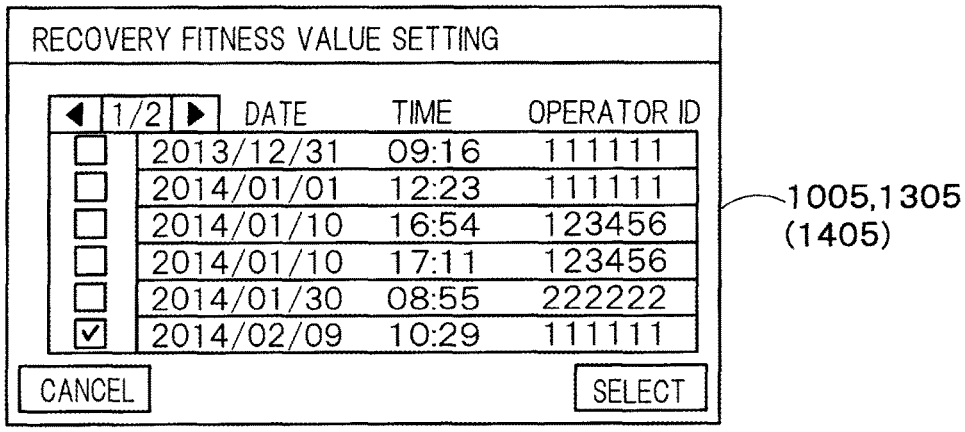
FIG. 17C illustrates another exemplary screen transferred from FIG. 17A.

In addition, when setting information is changed and set as new setting information, valuable medium handling machine 1100 may store the new setting information as history information associated with the date or time of the change in apparatus storage unit 1155 (see FIG. 16C and FIG. 17C). In addition, the setting information prior to the change may be stored as history information associated with the changed date or time in apparatus storage unit 1155 (see FIG. 16C and FIG. 17C).

History information of setting information stored in apparatus storage unit 1155 may include setting information of each item. The item may include at least one of an item relating to identification of a valuable medium in identification unit 1060, an item relating to the type of a valuable medium to be stored in stacking units 1080*a* and 1080*b*, an item relating to the display style of the display unit, and an item relating to network connection. Here, the setting information of the item relating to identification of a valuable medium may include a threshold used for identification of a valuable medium in identification unit 1060. It is to be noted that the threshold may have a value of 0 to 255 (values of 256 levels) for example. Here, in an exemplary case where the valuable medium is a banknote and the fitness of the banknote is to be identified, whether the banknote is "UNFIT," "Teller-FIT," or "ATM-FIT" is determined by comparing a threshold relating to the fitness stored in apparatus storage unit 1155 with a numerical value based on an identification result of identification unit 1060 by apparatus control unit 1150. Note that, a banknote which cannot be used as a dispensing banknote in an ATM provided at a financial institution such as a bank, but can be used as a dispensing banknote at a sales window of a financial institution such as a bank is sorted as "Teller-FIT," a banknote which is determined to be a fit note based on a strict threshold with respect to all fitness factors, and can be used in an ATM provided at a financial institution such as a bank as a dispensing banknote is sorted as "ATM-FIT," and a banknote which cannot be used as a dispensing banknote at a sales window of a financial institution such as a bank is sorted as "UNFIT."

Note that the factor for sorting the fitness of a valuable medium may include a plurality of fitness factors, namely, fitness factor 1 to fitness factor N, and fitness factor 1 to fitness factor N may include the shape, size, breaking, hole, dirt, abnormal watermark, fold, wrinkle, scribble, taping, fatigue, tearing and the like.

Apparatus control unit 1150 may read one or more pieces of history information associated with the acquired operator information (for example, an operator ID number and the like) from apparatus storage unit 1155. In this case, apparatus control unit 1150 may read the latest history information in the history information associated with the acquired operator information from apparatus storage unit 1155. In addition, it is also possible to read from apparatus storage unit 1155 only a predetermined number (for example, five pieces) of new information in the history information associated with the acquired operator information. In this case, for example, from operation/display unit 1005, the operator appropriately selects information from history information read from apparatus storage unit 1155. Note that, when predetermined pieces of information is not stored in apparatus storage unit 1155 in the case where a predetermined number of information is read as described above, all history information associated with the operator stored in apparatus storage unit 1155 is read.

Figure 15:
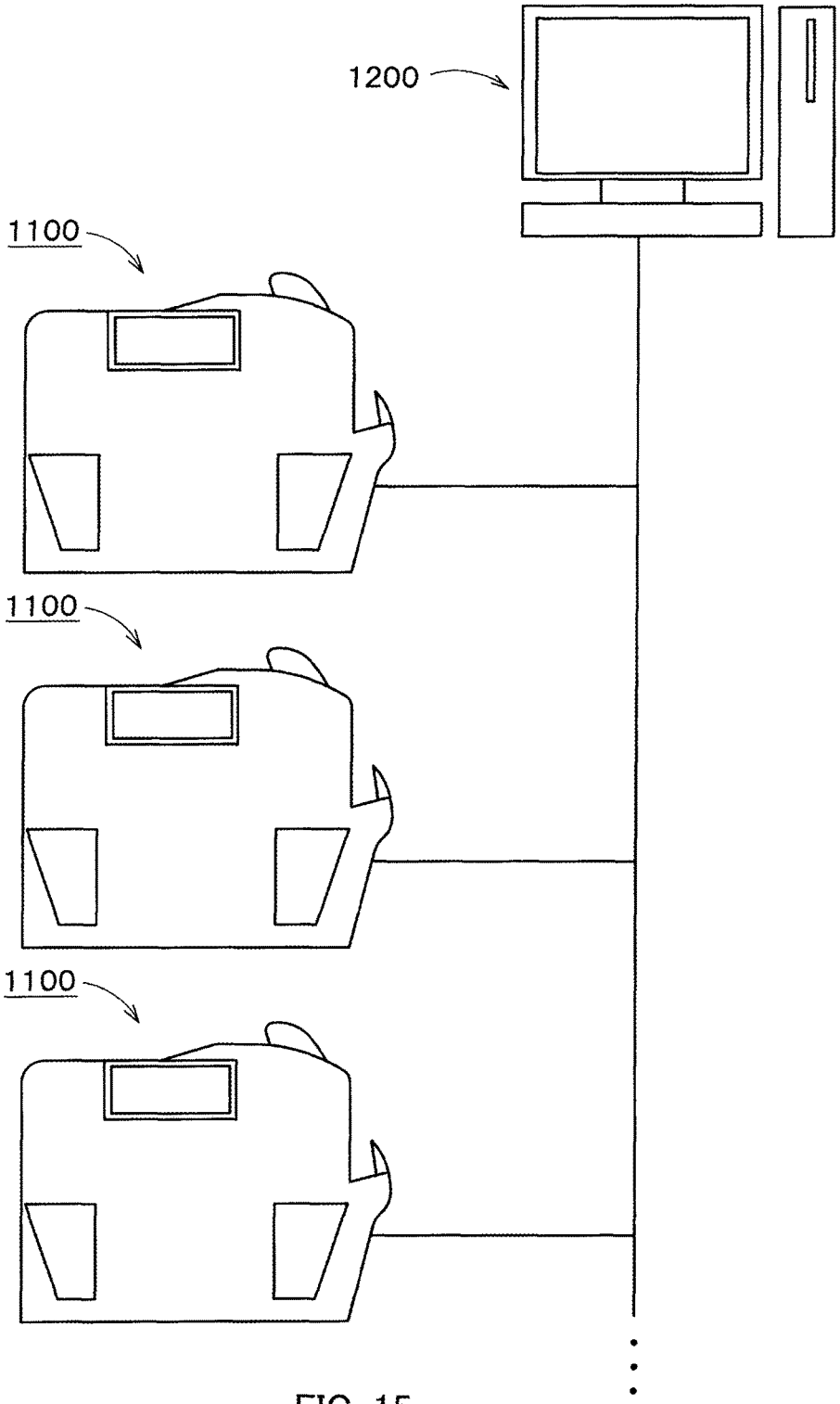
FIG. 15 illustrates a configuration of the valuable medium processing system of the embodiment of the present invention.

For example, the above-mentioned operator information may be acquired by input from operation/display unit 1005, or by receiving input from management apparatus 1200 (see FIG. 15) connected with valuable medium handling machine 1100, or, by operator information acquiring unit 1157 (see FIG. 14) composed of a card reader connected with valuable medium handling machine 1100 or the like. It is to be noted that, as illustrated in FIG. 15, one management apparatus 1200 may be connected with a plurality of valuable medium handling machines 1100, and the present invention is not limited to this. For example, one valuable medium handling machine 1100 may be connected with one management apparatus 1200.

It is to be noted that, when the operator information is acquired, the setting information for operating valuable medium handling machine 1100 set or used by the operator and the operator information of the operator may be stored in apparatus storage unit 1155 in association with each other.

Apparatus storage unit 1155 of the present embodiment may store setting information for each item. In the case where such a configuration is employed, apparatus control unit 1150 may read from apparatus storage unit 1155 setting information for each item. In addition, apparatus control unit 1150 may read from apparatus storage unit 1155 history information of setting information of a plurality of items at once. It is to be noted that the displays in FIG. 16A and FIG. 17A show "All Setting" for displaying history information of setting information of all items, "User Setting" for mainly displaying history information of setting information of an item set by the operator, "Network Setting" for displaying history information of setting information of an item relating to network connection, "Fitness Value Setting" for displaying information of setting information of an item relating to fitness history, "Genuine Value Setting" for displaying history information of setting information of an item relating to authentication, and "Maintenance Setting" for displaying history information of setting information of an item mainly used by a maintenance person. When "All Setting," "User Setting," "Network Setting" or "Maintenance Setting" is selected, history information of setting information of a plurality of items is read from apparatus storage unit 1155 at once and displayed. When "Fitness Value Setting" is selected, history information of setting information of an item relating to fitness is read and displayed. When "Genuine Value Setting" is selected, history information of setting information of an item relating to authentication is read and displayed.

While the "item" is described on the basis of an item such as an item relating to fitness and an item relating to authentication in the present embodiment, the present invention is not limited to this, and further specialized factors may be used as "item." Specifically, the "item" may be the fitness factors included in the item relating to fitness, namely, the shape, size, breaking, hole, dirt, abnormal watermark, fold, wrinkle, scribble, taping, fatigue, tearing and the like. In addition, the "item" may be the authentication factors included in the item relating to authentication, namely, the optimum filter selection determination, fluorescence determination, thread pattern determination, ink pattern determination, thickness, taping and the like. Note that, each of the fitness factors and the authentication factors may have a value of 0 to 255 (values of 256 levels), for example.

As illustrated in FIG. 14, valuable medium handling machine 1100 also includes apparatus control unit 1150 configured to control valuable medium handling machine 1100. As illustrated in FIG. 14, apparatus control unit 1150 is connected with intake unit 1020, first transport unit 1030, intermediate transport unit 1040, second transport unit 1050, identification unit 1060, apparatus storage unit 1155, diversion units 1076 and 1077, rejection unit 1110, stacking wheels 1081*a* and 1081*b*, sensors 10S1 to 10S6, 1089*a*, and 1089*b*, operation/display unit 1005, pushing units 1085*a* and 1085*b* and emission unit 1114. With this configuration, apparatus control unit 1150 acquires information from and/or gives request to intake unit 1020, first transport unit 1030, intermediate transport unit 1040, second transport unit 1050, identification unit 1060, apparatus storage unit 1155, diversion unit 1076 and 1077, rejection unit 1110, stacking wheels 1081*a* and 1081*b*, sensors 10S1 to 10S6, 1089*a*, 1089*b*, operation/display unit 1005, pushing units 1085*a* and 1085*b* and emission unit 1114.

It is to be noted that apparatus control unit 1150 is also connected with operator information acquiring unit 1157, external control unit 1350 described later and the like, and acquires information from and/or gives request to operator information acquiring unit 1157 and external control unit 1350.

Incidentally, while apparatus storage unit 1155 stores history information in the above-mentioned configuration, the present invention is not limited to this, and external storage unit 1355 (see FIG. 14) provided in external apparatus 1300 other than valuable medium handling machine 1100 may store history information. In addition, external storage unit 1355 may have a function identical to that of apparatus storage unit 1155. External storage unit 1355 is also included in "storage unit" recited in claims. Note that "external apparatus 1300" in the present embodiment means all apparatuses other than the subject apparatus, and "external apparatus 1300 other than valuable medium handling machine 1100" includes all apparatuses other than valuable medium handling machine 1100. An example of external apparatus 1300 is management apparatus 1200.

In addition, as illustrated in FIG. 14, external apparatus 1300 may include external operation unit 1306. It is possible to employ a configuration in which one piece of history information can be selected with external operation unit 1306 from among multiple pieces of history information read by apparatus control unit 1150. It is to be noted that external operation unit 1306 may have a function similar to that of operation/display unit 1005 as an operation unit.

In addition, as illustrated in FIG. 14, external apparatus 1300 may include external display unit 1305. It is to be noted that external display unit 1305 may have a function similar to that of operation/display unit 1005 as a display unit. External display unit 1305 is also included in "display unit" recited in claims.

In addition, as illustrated in FIG. 14, external apparatus 1300 may include external control unit 1350. External control unit 1350 may have a function similar to that of apparatus control unit 1150.

External control unit 1350 may have a function similar to that of apparatus control unit 1150 at least in function of reading the history information from apparatus storage unit 1155 or external storage unit 1355. External control unit 1350 is also included in "control unit" recited in claims. It is to be noted that while, in the following descriptions, apparatus control unit 1150 reads history information from storage unit 1455 described later, such a configuration is merely an example.

In the following descriptions, "storage unit 1455" is used as a term representing apparatus storage unit 1155, or external storage unit 1355, or, both of apparatus storage unit 1155 and external storage unit 1355. In addition, "operation unit 1406" is used as a term representing operation/display unit 1005, or external operation unit 1306, or, both of operation/display unit 1005 and external operation unit 1306. In addition, "operation unit 1405" is used as a term representing operation/display unit 1005, or external operation unit 1305, or, both of operation/display unit 1005 and external operation unit 1305. In addition, "control unit 1450" is used as a term representing apparatus control unit 1150, or external control unit 1350, or, both of apparatus control unit 1150 and external control unit 1350.

In addition, as described above, stacking units 1080*a* and 1080*b* are examples of the housing unit, and therefore, "housing unit 1480" is used in the following descriptions without using stacking units 1080*a* and 1080*b*. Housing unit 1480 may have a configuration in which paper sheets are stacked in a space isolated from the outside, and/or a configuration of a cassette system which is detachable to the apparatus main body, as well as the configuration of stacking units 1080*a* and 1080*b* in which an opening is provided on the front side. In addition, housing unit 1480 may have a configuration for stacking other valuable mediums such as coins as well as the configuration for stacking paper sheets (see coin housing unit 1160 of FIG. 19 described later).

(Method)

The following describes a configuration in which history information of setting information stored in storage unit 1455 is read in valuable medium handling machine 1100 of the present embodiment. It should be noted that this configuration is merely an example, and the present invention is not limited thereto.

Before valuable medium handling machine 1100 is operated, operator information for operating valuable medium handling machine 1100 is acquired from operation unit 1406, operator information acquiring unit 1157 and the like.

When operator information is acquired in this manner, display unit 1405 displays a screen for selecting history information. In the configuration illustrated FIG. 16A and FIG. 17A, "All Setting," "User Setting," "Network Setting," "Fitness Value Setting," "Genuine Value Setting" and "Maintenance Setting" are displayed on display unit 1405. It is to be noted that the contents displayed on display unit 1405 may be scrolled.

Also in FIG. 16A and FIG. 17A, another selection option may be displayed on display unit 1405 by scrolling the displayed content, or for example, by pressing the triangle arrow ("◄" or "►") illustrated in FIG. 16A and FIG. 17A.

When the operator selects setting information for reading history information from operation unit 1406, history information corresponding to the setting information stored in storage unit 1455 is displayed on display unit 1405. Note that, FIG. 16B and FIG. 16C illustrate an example display resulting from selection of "All Setting" in FIG. 16A, and FIG. 17B and FIG. 17C illustrate an example display resulting from selection of "Fitness Value Setting" in FIG. 17A.

The operator selects history information to be restored by pressing down a check box for example in operation unit 1406. In this manner, the content of the selected history information is set for each item or a plurality of items in valuable medium handling machine 1100.

When history information of setting information is displayed, display unit 1405 may read history information stored in storage unit 1455, and display the information in a list as illustrated in FIG. 16B, FIG. 16C, FIG. 17B and FIG.

17C. To be more specific, display unit 1405 may display a list of history information of setting information set or used by the operator in a configuration including the operator, or display a list of history information of setting information in a configuration including the date and time when the setting is performed or the date and time when the information is used (see FIG. 16B and FIG. 17B). In addition, as a matter of course, a list of history information of setting information may be displayed in a configuration including the operator and the date and time when the setting is performed or the date and time when the information is used (see FIG. 16C and FIG. 17C). It is to be noted that in the configuration illustrated in FIG. 16B, FIG. 16C, FIG. 17B and FIG. 17C, the specific detail of the history information may be displayed on display unit 1405 by selecting one piece of history information by pressing down the date and time and/or the operator ID number in operation unit 1406, not the check box, for example.

In addition, it is possible that, when the operator information is acquired, apparatus control unit 1150 reads from storage unit 1455 one or more pieces of history information associated with the acquired operator information. In this case, display unit 1405 may display a list of history information of setting information set or used by the operator in a configuration including the operator, or display a list of history information of setting information set or used by the operator in a configuration including the operator and the date and time when the setting is performed or the date and time when the information is used (see FIG. 16C and FIG. 17C).

In the case where storage unit 1455 stores setting information for each item, control unit 1450 may read setting information from storage unit 1455 for each item, and display setting information on display unit 1405 for each item (see FIG. 17B and FIG. 17C). In this case, the items may not be displayed one by one, and control unit 1450 may read setting information of a plurality of items at once from storage unit 1455 and display the setting information of a plurality of items on display unit 1405 at once (see FIG. 16B and FIG. 16C).

The history information stored in storage unit 1455 may include a threshold used for identification of a valuable medium in identification unit 1060. In addition, the history information of setting information stored in storage unit 1455 may include at least one of history information of setting information relating to identification of a valuable medium in identification unit 1060, history information of setting information relating to the type of the valuable medium to be housed in housing unit 1480, history information of setting information relating to the display style on display unit 1405, and history information of setting information relating to network connection.

When a list of history information of setting information is displayed on display unit 1405, the operator may select one piece of history information from multiple pieces of history information in operation unit 1406, and perform setting of the valuable medium handling machine by the setting detail identical to that of the selected history information. In this case, the operator may change the history information to select for each item.

In addition, it is possible that, when the operator information is acquired as described above, control unit 1450 reads setting information associated with the acquired operator information from storage unit 1455 such that the setting of valuable medium handling machine 1100 is automatically performed. Here, in the case where multiple pieces of setting information are stored as history information, the latest history information may be read from storage unit 1455. In this case, the setting of valuable medium handling machine 1100 is automatically performed based on the read latest history information. In addition, it is possible to read from information storage unit 1455 only a predetermined number (for example, five pieces) of new information in the history information associated with the acquired operator information. In this case, for example, the operator appropriately selects history information read from storage unit 1455 from operation unit 1406, thereby performing setting of valuable medium handling machine 1100 based on the history information.

In the case where a valuable medium is processed in valuable medium handling machine 1100 by using, as setting information, already set information as it is and/or by using, as setting information, information selected from operation unit 1406, information automatically set or information changed by the operator in the read history information, the fact that the setting information is used by the operator may be stored as history information in storage unit 1455 when the operator establishes the setting and/or starts the processing of a valuable medium by operation unit 1406. In this case, storage unit 1455 may store the information used by the operator and setting information in association with each other, or store setting information and the date and time (when the setting is established and/or processing of a valuable medium is started) in association with each other, or, as a matter of course, store the operator who used the information and the date and time (when the setting is established and/or processing of a valuable medium is started) in association with setting information. In addition, an ID (transaction ID or processing ID) for identifying processing of a valuable medium on the basis of the processing, and setting information may be stored in storage unit 1455 in association with each other.

In the case where a valuable medium is processed in valuable medium handling machine 1100 after already set information or information selected from operation unit 1406 in the read history information is changed, the fact that the setting information is changed and used by the operator may be stored as history information in storage unit 1455 when the operator establishes the setting and starts processing of a valuable medium by operation unit 1406 after the history information is changed by operation unit 1406. Also in this case, storage unit 1455 may store the operator who performed the setting and the information set anew in association with each other in storage unit 1455, or store the information set anew and the date and time (when the setting is established and/or processing of a valuable medium is started) in association with each other, or, as a matter of course, store the operator who performed the setting and the date and time (when the setting is established and/or processing of a valuable medium is started) associated with the information set anew. In addition, an ID (transaction ID or processing ID) for identifying processing of a valuable medium on the basis of the processing, and the information set anew may be stored in storage unit 1455 in association with each other.

In addition, a configuration may also be employed in which setting information acquired at a given interval (for example, every week) is stored as history information in storage unit 1455 (see FIG. 16B and FIG. 17B), and such a configuration may be used alone or in combination with the above-mentioned configurations. In the case where such a configuration is combined with the above-described configurations, the setting information at that time is stored as history information every time when a valuable medium is processed in valuable medium handling machine 1100 or every time when setting information is changed, and in addition, setting information is read at a given interval and stored as history information.

It is to be noted that a configuration may also be employed in which, when setting information is changed during the setting in valuable medium handling machine 1100, the setting information prior to the change is stored as history information in storage unit 1455, and such a configuration may be used alone or in combination with the above-mentioned configurations.

(Effect)

Next, other effects or particularly important effects achieved with valuable medium handling machine 1100 of the present embodiment are described.

According to the present embodiment, it is possible to read history information of setting information of at least one item for operating valuable medium handling machine 1100. Accordingly, even in the case where the detail of the setting information is changed, it is possible to easily reset to the original detail of the setting information of the item by reading the history information.

In addition, according to the present embodiment, storage unit 1455 may store history information by associating the operator who performed or used the setting and setting information. In this case, display unit 1405 can display history information of setting information set or used by the operator in a configuration including the operator (see FIG. 16C and FIG. 17C). Accordingly, by appropriately selecting the operator (typically, by selecting the operator himself or herself), the operator can read the history information of the detail desired to be set. In this case, it is possible to display only history information relating to the operator. It is to be noted that, in the case where the operator wants to use setting information set by the other operator, the operator can operate valuable medium handling machine 1100 with use of the setting information set by the other operator by selecting the other operator.

In addition, storage unit 1455 may store history information by associating the date and time when the setting is performed or used and setting information. In this case, display unit 1405 can display history information of setting information in a configuration including the date and time when the setting is performed or used (see FIG. 16B and FIG. 17B). Accordingly, by appropriately selecting the date and time (typically, by selecting the date and time when the setting is finally performed or used by the operator), the operator can read the history information of the detail desired to be set.

It is to be noted that in the case where storage unit 1455 stores history information by associating the operator and date and time when the setting is performed, or, the operator and the date and time when the setting is used, with setting information, display unit 1405 can display history information of setting information in a configuration including the operator and date and time when the setting is performed, or, the operator and the date and time when the setting is used (see FIG. 16C and FIG. 17C). Accordingly, by appropriately selecting the operator and date and time (typically, by selecting the operator himself or herself as the operator, and the date and time when the setting is finally performed or used), the operator can read history information of the detail desired to be set.

Note that, in the case where history information can be retrieved is employed, history information of setting information which is desired to be acquired can be extracted by retrieving the information with use of the operator and/or the date and time, and the like. Accordingly, the operator can easily acquire the history information of the setting information acquired by the operator himself or herself. In the case where history information is retrieved in the above-mentioned manner, the range regarding the date and time may be narrowed at the time of retrieving the history information.

In the present embodiment, in the case where a configuration in which setting information acquired at a given interval (for example, every week) is stored in storage unit 1455 as history information is employed, the setting information can be updated at the given interval as necessary. Accordingly, the setting information of valuable medium handling machine 1100 can be stored in storage unit 1455 while updating the information as necessary.

In addition, it is also possible that, in the case where setting information included in history information read from storage unit 1455 is not changed, setting information included in the history information read from storage unit 1455 is changed and set as new setting information, while the setting information is not again stored as history information in storage unit 1455 such that the information set anew is stored as history information in storage unit 1455. In the case where such a configuration is employed, the setting information can be stored as history information in storage unit 1455 only when setting information read from storage unit 1455 is changed, and thus the latest setting information can be stored in storage unit 1455 with a small capacity.

In addition, even in the case where setting information included in history information read from storage unit 1455 is not changed, the setting information may be stored as history information in storage unit 1455 when a valuable medium is processed in valuable medium handling machine 1100 with use of the setting information. In the case where such a configuration is employed, the setting information can be stored as history information in storage unit 1455 even when setting information read from storage unit 1455 is not changed. As a result, when, for example, setting information is stored in association with the date and time in storage unit 1455, the operator can read setting information (history information) used by the operator by selecting the latest date and time without returning back to the old date and time.

In addition, it is possible that, when setting information is changed (during the setting in valuable medium handling machine 1100, for example), the setting information prior to the change is stored as history information in storage unit 1455. In the case where such a configuration is employed, it is possible to store the setting information prior to the change as history information in storage unit 1455 only when setting information is changed, and also in this case, the latest setting information can be stored in storage unit 1455 with a small capacity.

While various display styles of display unit 1405 are conceivable, a configuration in which display unit 1405 displays a list of history information (see FIG. 16B, FIG. 16C, FIG. 17B and FIG. 17C) is very useful since the operator can confirm the history information at a glance. In the case where the date and time when the setting is performed or used and setting information are stored in association with each other, display unit 1405 may display setting information in a list (list display) in the order of newer date and time when the setting is performed or used, for example. In addition, in the case where the operator who performed or used the setting and setting information are stored in association with each other, display unit 1405 may display the setting information in a list in the order of ID number of the operator who performed or used the setting, or, Japanese phonetic (a-i-u-e-o) order or alphabetic order of the name of the operator, for example.

In the case where the history information stored in storage unit 1455 includes a threshold used for identification of a valuable medium in identification unit 1060, historical setting information relating to a threshold can be appropriately read. Accordingly, a valuable medium can be sorted by identifying the valuable medium with use of a threshold identical to that of a certain time point, for example. In view of this, since sorting of a valuable medium with the threshold can largely vary depending on the setting, the above-mentioned configuration in which historical setting information relating to the threshold can be appropriately read is very useful.

In addition, in the case where the history information stored in storage unit 1455 includes history information of setting information relating to identification of a valuable medium in identification unit 1060, not only the above-described threshold, but also history information of setting information relating to identification of a valuable medium can be appropriately read. Accordingly, a valuable medium can be identified with use of setting information identical in identification to that of a certain time point, for example.

In addition, in the case where the history information stored in storage unit 1455 includes history information of setting information relating to the type of a valuable medium to be housed in housing unit 1480, setting information relating to a valuable medium to be housed in housing unit 1480 can be appropriately read. Accordingly, a valuable medium can be housed in housing unit 1480 with use of a sort pattern (stacking unit pattern) identical to that of a certain time point, for example. In an exemplary case where valuable medium handling machine 1100 is a paper sheet processing machine, history information relating to a paper sheet to be housed in housing unit 1480 such as the stacking unit and the rejection unit can be read, and a paper sheet can be housed in housing unit 1480 with use of a sort pattern identical to that of a certain time point. In this stacking unit pattern, any of a designation mode, an automatic determination mode, a dynamic determination mode, a mixture mode and a non-designation mode may be set for the kind of a currency, the kind of a banknote, the printing type of a banknote, the fitness of a paper sheet, the front/back of a paper sheet, the orientation of a paper sheet and the like in housing unit 1480.

Here, the designation mode is a mode for preliminarily designating the detail of the sort type of the valuable medium to be housed in housing unit 1480. The automatic determination mode is a mode for setting the detail of the sort type identified in the designated order by identification unit 1060 (for example, first, second, and so forth) to the valuable mediums to be housed in the corresponding housing unit 1480 in the process of the valuable medium of one operation. The dynamic determination mode is a mode for assigning the valuable medium to be housed in housing unit 1480 based on the result of the identification of identification unit 1060 during the processing of the money, and differs from the automatic determination mode in that assignment can be performed regardless of the order of the valuable medium. For example, in the case where the type of the identified valuable medium is not assigned to housing unit 1480, and there are housing unit 1480 whose dynamic determination mode is set but whose assignment is not determined, the detail of the identified valuable medium is assigned to that housing unit 1480. The mixture mode is a mode for stacking valuable mediums regardless of the detail of the sort type. The non-designation mode is a mode for stacking valuable mediums which are not housed in other housing unit 1480.

In addition, in the case where the history information stored in storage unit 1455 includes history information of setting information relating to the display style on display unit 1405, setting information relating to the display style on display unit 1405 can be appropriately read. Accordingly, display unit 1405 can display various information with use of a display style identical to that of a certain time point, for example. It is to be noted that the display style includes the color, brightness, letter size, detail of information to be displayed, position of displayed information and the like of display unit 1405.

In addition, in the case where the history information stored in storage unit 1455 includes history information of setting information relating to network connection, setting information relating to network connection can be appropriately read. Accordingly, valuable medium handling machine 1100 can be connected to external apparatus 1300 with use of network setting identical to that of a certain time point, for example. Thus, even in the case where network connection is not established due to replacement, addition, and the like of external apparatus 1300 of management apparatus 1200, and the like, network connection can be easily established with use of setting information of a certain historical time point (for example, by referring to setting information of a certain historical time point), for example.

In the case where the valuable medium is a paper sheet, the history information of setting information stored in storage unit 1455 may include whether to acquire identification information of a paper sheet (typically, the serial number of a banknote). In addition, the history information of setting information stored in storage unit 1455 may include whether to emit a warning buzzer (not illustrated) in the case of error, whether to confirm whether housing unit 1480 is filled with valuable mediums, whether to automatically take valuable mediums from intake unit 1020, and the like. In the case where the above-mentioned information is included, the setting information of such information at a certain historical time point can also be easily restored.

In addition, in the case where a configuration in which apparatus control unit 1150 reads one or more pieces of history information associated with acquired operator information from storage unit 1455 is employed, the operator can read history information of the setting information previously used by the operator by only allowing information of the operator to be acquired. Here, in the case where display unit 1405 displays of a list of history information of setting information set or used by the operator corresponding to the operator information in a configuration including the date and time when the setting is performed or the date and time when the information is used, the operator can select the setting information previously set or used by operator while confirming the information with the list.

It is to be noted that it is not necessary to read all of the historical setting information as history information, and for example, only a predetermined number (for example, five pieces) of new information in the history information associated with the acquired operator information may be read from storage unit 1455. In the case where such a configuration is employed, it is possible to read only setting information which is highly possibly required by the process to be performed next in valuable medium handling machine 1100, and it is thus possible to reduce the possibility of a situation where the operator is confused in selection of setting information. Note that, it is possible that "predetermined number" to be displayed is changed by performing a predetermined operation, and/or all of historical setting information is read by performing a predetermined operation.

In addition, in the case where the configuration in which the latest history information in the history information associated with the acquired operator information is read from storage unit 1455 is employed, apparatus control unit 1150 can automatically perform the setting of valuable medium handling machine 1100 based on the read latest history information. Accordingly, the operator can operate valuable medium handling machine 1100 with use of latest setting information previously used by the operator without thinking or operating.

In the case where storage unit 1455 stores setting information for each item, it is possible to read only history information of an item required to be read and use the information for setting. For example, it is possible that only history information of an item which is relatively frequently changed and/or an item which is important for processing of a valuable medium is read without reading the history information of an item which is not frequently changed and/or an item which is not important for processing of a valuable medium. In the case where such a configuration is employed, history information can be used within a necessary limit, and thus the task of the operator in setting of valuable medium handling machine 1100 can be reduced. In addition, in the case where such a configuration is employed, pieces of history information different from each other can be used for each item, and pieces of setting information which are different in operator and/or the date and time between item A and item B can be used. Accordingly, with this configuration, setting information can be further flexibly set in accordance with the process desired to be performed.

For example, when "Fitness Value Setting" is selected as illustrated in FIG. 17A, history information of setting information relating to fitness is displayed in a list on display unit 1405 as illustrated in FIG. 17B or FIG. 17C. When information is selected from the history information displayed in a list, setting information relating to fitness at that time point (at 9 o'clock on Jan. 13, 2014 in FIG. 17B, or at 10:29 on Feb. 9, 2014 in FIG. 17C) is restored and set.

On the other hand, when "All Setting" is selected as illustrated in FIG. 16A, history information of setting information for all items as illustrated in FIG. 16B or FIG. 16C is displayed on display unit 1405 in a list. Then, when information is selected from the history information displayed in a list, setting information for all items at that time point (at 9 o'clock on Jan. 13, 2014 in FIG. 16B, or at 10:20 on Jan. 15, 2014 in FIG. 16C) is restored and set.

The same applies to other points. That is, when "User Setting" is selected and information is selected from the list of the history information displayed on display unit 1405, setting information of an item which is set mainly by the operator at that time point is restored and set. In addition, when "Network Setting" is selected and information is selected from the list of the history information displayed on display unit 405, setting information relating to network connection at that time point is restored and set. In addition, when "Genuine Value Setting" is selected and information is selected from the list of the history information displayed on display unit 405, setting information relating to authentication at that time point is restored and set. In addition, when "Maintenance Setting" is selected and information is selected from the list of the history information displayed on display unit 1405, setting information of an item mainly used by a maintenance person at that time point is restored and set.

In addition, it is also possible to restore the date and time and/or the operator of setting information relating to fitness to be restored, and the date and time and/or the operator of setting information relating to authentication to be restored which are different from each other.

To be more specific, a combination of pieces of setting information can be used such that setting information which was set or used by the operator "111111" at 10:29 on Feb. 9, 2014 is used for fitness, and setting information which was set or used by the operator "222222" at 8:55 on Jan. 30, 2014 is used for authentication.

Note that, as described above, correction may be appropriately performed based on setting information which is restored and set. Accordingly, even after setting information relating to fitness is restored and set, the threshold of each fitness factor included in setting information relating to the fitness may be changed and stored in storage unit 455, and likewise, even after setting information relating to authentication is restored and set, the threshold of each authentication factor included in setting information relating to the authentication may be changed and stored in storage unit 1455, for example.

It is to be noted that, for example, in the case where a configuration in which apparatus control unit 1150 reads history information of setting information from storage unit 1455 for each item, and the history information is displayed on display unit 1405 is employed as the case where "Fitness Value Setting" or "Genuine Value Setting" are selected, the operator can appropriately select information by displaying on display unit 1405 only history information of setting information of an item desired to be read, and thus the task of the operator in selection can be reduced.

In addition, for example, in the case where a configuration in which apparatus control unit 1150 reads from storage unit 1455 history information of setting information of a plurality of items at once, and the history information is displayed on display unit 1405 is employed as the case where "All Setting," "User Setting," "Network Setting" or "Maintenance Setting" are selected, history information of setting information of a plurality of concerned items can be confirmed at once. In this case, advantageously, it is unnecessary to confirm history information of setting information of the items multiple times.

It should be understood by those skilled in the art that various modifications, combinations, sub-combinations and alterations may occur depending on design requirements and other factors in so far as they are within the scope of the appended claims or the equivalents thereof.

Figure 18:
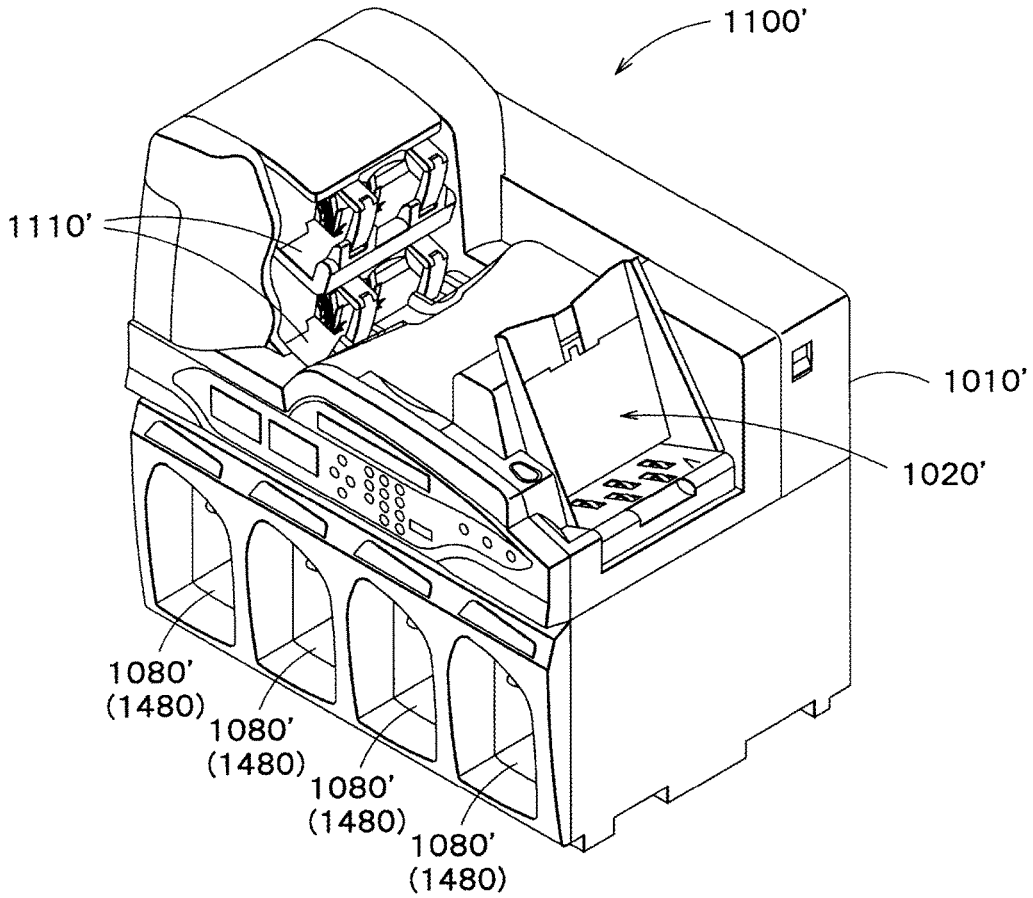
FIG. 18 is a perspective view illustrating an external appearance of another valuable medium handling machine (paper sheet processing machine) used in the embodiment of the present invention.

Accordingly, the valuable medium handling machine is not limited to the configuration illustrated in FIG. 12 and FIG. 13, and a paper sheet handling machine including one stacking unit, a paper sheet handling machine including three or more stacking units 1080' (see FIG. 18), and valuable medium handling machine 1100' including a plurality of rejection units 1110' (see FIG. 18) may be employed. In FIG. 18, members having functions similar to those of valuable medium handling machine 1100 illustrated in FIG. 12 and FIG. 13 are denoted with the corresponding numerals of valuable medium handling machine 1100 illustrated in FIG. 12 and FIG. 13 with "'". It is to be noted that a typical example of a paper sheet processing machine is a banknote processing machine.

Figure 19:
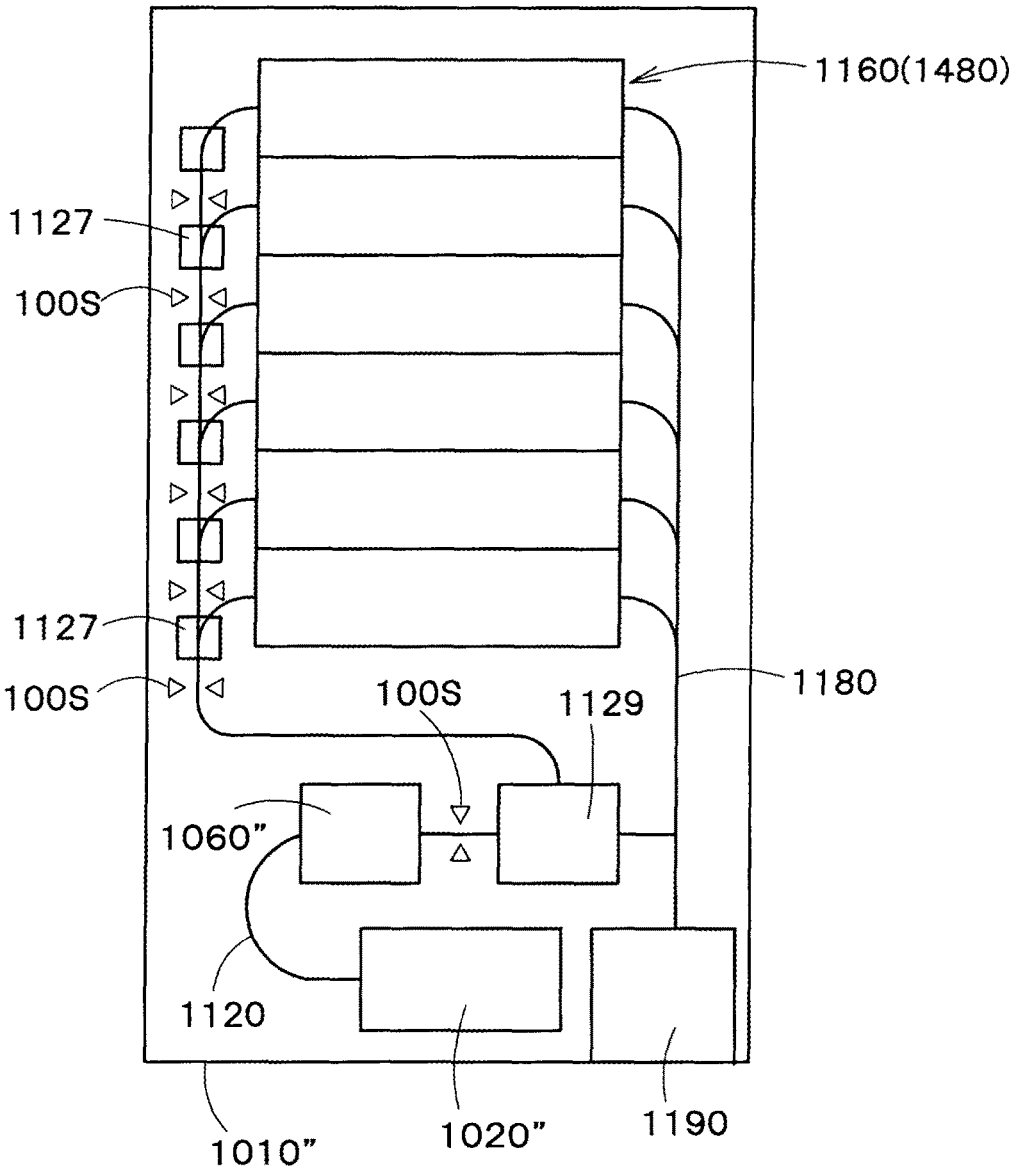
FIG. 19 schematically illustrates an internal configuration of an internal configuration of still another valuable medium handling machine (coin processing machine) used in the embodiment of the present invention.

In addition, a coin processing machine illustrated in FIG. 19 may also be employed as the valuable medium handling machine. In the coin processing machine illustrated in FIG. 19, reference numeral 1160 indicates a coin housing unit (an example of housing unit 1480) configured to house coins and send out the housed coins, reference numeral 1120 indicates a deposit coin transport unit configured to transport a coin input from intake unit 1020" to coin housing unit 1160 one by one along the deposit path, reference numeral 1180 indicates a dispense coin transport unit configured to transport a coin sent out from coin housing unit 1160 along a dispense path, and reference numeral 1190 indicates a coin paying unit configured to dispense a coin sent out to the dispense path and transported by dispense coin transport unit 1180. Reference numeral 1127 indicates a deposit distribution unit provided corresponding to a denomination-basis coin feeding housing unit included in coin housing unit 1160. The deposit distribution unit takes a coin and houses the coin in the corresponding denomination-basis coin feeding housing unit. Reference numeral 1129 indicates a rejection distribution unit configured to distribute coins whose denomination and the like cannot be identified by identification unit 1060" as rejected coins, and reference numeral 100S indicates a sensor. In FIG. 19, members having functions similar to those of valuable medium handling machine 1100 illustrated in FIG. 12 and FIG. 13 are denoted with the corresponding numerals of valuable medium handling machine 1100 illustrated in FIG. 12 and FIG. 13 with "".

REFERENCE SIGNS LIST

50 Main control unit (control unit)
55 Identification unit
56 Main storage unit (storage unit)
70 Transport unit
71 Driving unit
60*a* to 60*p* Stacking unit
105 Upper unit
105*a* Upper driving unit
110 First stacker unit
110*a* First lower driving unit
120 Second stacker unit
120*a* Second lower driving unit
130 Third stacker unit
130*a* Third lower driving unit
135 Stacking unit control unit (control unit)
136 Stacking unit storage unit (storage unit)
140 Fourth stacker unit
140*a* Fourth lower driving unit
210*a* to 210*c* Bundling escrow unit
500 External apparatus
540 External display unit
550 External control unit (control unit)
560 External storage unit (storage unit)
1005 Operation/display unit (display unit)
1060 Identification unit
1080*a*, 1080*b* Stacking unit (housing unit)
1100 Valuable medium handling machine
1150 Apparatus control unit
1155 Apparatus storage unit (storage unit)
1200 Management apparatus
1300 External apparatus
1305 External display unit
1355 External storage unit
1405 Display unit
1455 Storage unit
1480 Housing unit

The invention claimed is:

1. A paper sheet processing method comprising:

identifying, by a sensor, details of a sort type of a paper sheet transported by a transport unit, stacking the paper sheet in one of plurality of stacking units based on the detail of the sort type of the paper sheet identified by the sensor, setting an upper limit number to limit a number of paper sheets to be stacked in each stacking unit based on a detail of the sort types of paper sheets to be stacked in the corresponding stacking unit, and when a number of paper sheets stacked in each stacking unit reaches the set upper limit number of paper sheets to be stacked in the corresponding stack, controlling the transport unit to stop the stacking of the paper sheet in the corresponding stacking unit, and stacking the paper in another stacking unit.

2. The paper sheet processing method according to claim 1, further comprising:

reading from a storage unit data on the upper limit number of paper sheets to be stacked in the stacking unit, the data being stored in the storage unit, and linked with the details of the sort type of the paper sheets; and setting the upper limit number to the number of paper sheets to be stacked in each stacking unit to the upper limit number read from the storage unit.

* * * * *